US009534269B2

(12) United States Patent
Ono et al.

(10) Patent No.: US 9,534,269 B2
(45) **Date of Patent: *Jan. 3, 2017**

(54) HIGH STRENGTH COLD ROLLED STEEL SHEET AND METHOD FOR MANUFACTURING THE SAME

(71) Applicant: JFE Steel Corporation, Tokyo (JP)

(72) Inventors: Yoshihiko Ono, Fukuyama (JP); Kenji Takahashi, Fukuyama (JP); Kaneharu Okuda, Chiba (JP); Shoichiro Taira, Fukuyama (JP); Michitaka Sakurai, Fukuyama (JP); Yusuke Fushiwaki, Fukuyama (JP)

(73) Assignee: JFE Steel Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/058,580

(22) Filed: Oct. 21, 2013

(65) Prior Publication Data

US 2014/0102596 A1 Apr. 17, 2014

Related U.S. Application Data

(62) Division of application No. 13/387,393, filed as application No. PCT/JP2010/062985 on Jul. 27, 2010.

(30) Foreign Application Priority Data

Jul. 28, 2009 (JP) ..... 2009-174846

(51) Int. Cl.
*C21D 8/02* (2006.01)
*C22C 38/04* (2006.01)
(Continued)

(52) U.S. Cl.
CPC ..... *C21D 8/0236* (2013.01); *C21D 8/02* (2013.01); *C22C 38/04* (2013.01); *C22C 38/06* (2013.01);
(Continued)

(58) Field of Classification Search
CPC ..... C22C 38/00–38/04; C21D 8/02; C21D 8/0236
(Continued)

(56) References Cited

U.S. PATENT DOCUMENTS

2003/0111144 A1 6/2003 Matsuoka et al.

FOREIGN PATENT DOCUMENTS

JP 62-040405 B 8/1987
JP 62-182225 A 8/1987
(Continued)

*Primary Examiner* — Brian Walck
(74) *Attorney, Agent, or Firm* — DLA Piper LLP (US)

(57) ABSTRACT

A method of manufacturing a high strength cold rolled steel sheet includes hot-rolling and cold-rolling a steel slab annealing the steel sheet at an annealing temperature of 750° C. to 830° C.; subjecting the steel sheet to first cooling at an average cooling rate of 3° C./sec to 40° C./sec in a temperature range from the annealing temperature to 480° C.; subjecting the steel sheet to second cooling at an average cooling rate of 8° C./sec to 80° C./sec in a temperature range from 480° C. to Tc (° C.) given by formula (6):

$$Tc=435-40\times[\%\ Mn]-30\times[\%\ Cr]-30\times[\%\ V] \quad (6)$$

wherein [% A] is the content (% by mass) of alloying element A; and subjecting the steel sheet to third cooling at an average cooling rate of 0.3° C./sec to 30° C./sec in a temperature range from Tc (° C.) to 200° C.

10 Claims, 3 Drawing Sheets

(51) Int. Cl.
*C22C 38/06* (2006.01)
*C22C 38/58* (2006.01)

(52) U.S. Cl.
CPC ..... *C22C 38/58* (2013.01); *C21D 2211/005* (2013.01); *C21D 2211/008* (2013.01)

(58) Field of Classification Search
USPC ..... 148/320, 333, 506, 533, 579, 648,148/650–654; 420/104; 428/659, 684
See application file for complete search history.

(56) References Cited

FOREIGN PATENT DOCUMENTS

| | | | |
|---|---|---|---|
| JP | 08-003677 | A | 1/1996 |
| JP | 2001-207237 | A | 7/2001 |
| JP | 2001-220641 | A | 8/2001 |
| JP | 2003-129172 | A | 5/2003 |
| JP | 2006-233294 | A | 9/2006 |
| JP | 3969350 | B2 | 9/2007 |
| JP | 4113036 | B2 | 7/2008 |
| JP | 2009-035816 | A | 2/2009 |
| JP | 2010-196159 | A | 9/2010 |
| WO | 2009/008551 | A1 | 1/2009 |

HIGH STRENGTH COLD ROLLED STEEL SHEET AND METHOD FOR MANUFACTURING THE SAME

TECHNICAL FIELD

This disclosure relates to high strength cold rolled steel sheets for press forming that are used in, for example, automobiles and home appliances through a press forming process and methods for manufacturing such steel sheets.

BACKGROUND

Conventionally, 340 MPa class bake-hardenable (BH) steel sheets (hereinafter referred to as "340BH") have been applied to automotive outer panels such as hoods, doors, trunk lids, back doors, and fenders, which require dent resistance.

340BH is a ferrite single-phase steel produced by adding carbide or nitride-forming elements such as niobium and titanium to an ultralow carbon steel containing less than 0.01% by mass of carbon to control the amount of carbon dissolved therein and strengthening the steel with manganese and phosphorus by solid solution strengthening. There has been a growing need for lightweight car bodies. Further research has been conducted on, for example, further increasing the strength of outer panels, to which 340BH has been applied, to reduce the thickness of the steel sheets, reducing the number of reinforcements (R/F; inner reinforcing parts) with the same thickness, and reducing the temperature and time of a bake hardening process.

However, adding larger amounts of manganese and phosphorus to the conventional 340BH for increased strength noticeably degrades the surface distortion resistance of press-formed products because YP increases. The term "surface distortion" refers to a pattern of extremely small wrinkles and waves that tend to appear on a press-formed surface, for example, at the periphery of a doorknob.

Surface distortion noticeably impairs the surface appearance quality of automobiles. Therefore, a steel sheet applied to outer panels requires a low YP close to that of the currently used 340BH as well as increased strength of pressed products.

In addition, steels having higher strengths than 340BH tend to have variations in material properties such as YP, TS, and El, and are therefore liable to surface distortion and breakage. If such steel sheets with high YP have little variation in material properties, surface distortion on design surfaces can be reduced by adjusting the shape of a press die. However, it is extremely difficult to reduce surface distortion if YP and TS vary within a coil in the longitudinal or width direction, or vary between coils. This is because grinding a press die to adjust the surface shape for each coil is impractical in mass production, and adjusting the press conditions such as forming pressure has a little effect of improving surface distortion. Accordingly, there is a need for a high strength steel sheet having low YP and little variation in material properties within a coil or between coils at the same time.

Furthermore, a steel sheet used for automobiles is also required to have excellent corrosion resistance. Since steel sheets are closely in contact with each other at a hem processing portion and a spot welding peripheral portion of body parts such as a door, a hood and trunk lid, chemical conversion films are difficult to form by electrocoating. Hence, rust is easy to form. In particular, in corner portions at a front side of a hood and a lower side of a door at which water is liable to remain and which are exposed to a wet atmosphere for a long time, holes are frequently generated by rust.

Furthermore, in recent years, car body manufactures have been considering on increasing the hole-forming resistant life to 12 years from a conventional life of 10 years by improving corrosion resistance of car bodies. Hence, a steel sheet must have sufficient corrosion resistance.

Against this backdrop, for example, Japanese Examined Patent Application Publication No. 6-35619 discloses a technique for producing a cold-rolled steel sheet with high elongation by maintaining a steel containing, in percent by weight, 0.10% to 0.45% of carbon, 0.5% to 1.8% of silicon, 0.5% to 3.0% of manganese, and 0.01% to 0.07% of soluble aluminum in the temperature range of 350° C. to 500° C. for 1 to 30 minutes after annealing to form 5% to 10% or more of retained γ.

In addition, Japanese Examined Patent Application Publication No. 62-40405 discloses a method for producing a high strength steel sheet combining low yield stress (YP), high elongation (El), and high bake hardenability (BH) by adjusting the cooling rate, after annealing, of a steel containing, by weight, 0.005% to 0.15% of carbon, 0.3% to 2.0% of manganese, and 0.023% to 0.8% of chromium to form a dual-phase structure composed mainly of ferrite and martensite.

Furthermore, Japanese Patent No. 3969350 discloses a method for producing a high strength steel sheet having excellent bake hardenability and excellent room-temperature anti-aging properties by adding 0.02% to 1.5% of molybdenum to a steel containing, in percent by mass, more than 0.01% to less than 0.03% of carbon, 0.5% to 2.5% of manganese, and 0.0025% or less of boron and controlling the soluble aluminum, nitrogen, boron, and manganese contents to satisfy $sol.Al \geq 9.7 \times N$ and $B \geq 1.5 \times 10^4 \times (Mn^2+1)$ to form a microstructure composed of ferrite and a low-temperature transformed phase.

Japanese Patent No. 4113036 discloses that a steel sheet having excellent anti-aging properties at room temperature and excellent bake hardenability can be produced using a steel containing, in percent by mass, 0.2% or less of carbon, 3.0% or less of manganese, 0.0030% to 0.0180% of nitrogen, 0.5% to 0.9% of chromium, and 0.020% or less of aluminum by adjusting the ratio of chromium to nitrogen to 25 or more and the area ratio of ferrite to 80% or more.

Japanese Unexamined Patent Application Publication No. 2009-35816 discloses a method for manufacturing a high strength cold rolled steel sheet having low yield stress and little variation in material properties with annealing temperature using a steel containing, in percent by mass, more than 0.01% to less than 0.08% of carbon, 0.8% to less than 1.7% of manganese, and more than 0.4% to 2% of chromium by adjusting the composition ratio of chromium to manganese to $Cr/Mn \geq 0.34$ and the heating rate in annealing to lower than 3° C./s.

Japanese Unexamined Patent Application Publication No. 2006-233294 discloses a method for producing a steel sheet having excellent bake hardenability using a steel containing, in percent by mass, 0.01% to less than 0.040% of carbon, 0.3% to 1.6% of manganese, 0.5% or less of chromium, and 0.5% or less of molybdenum by cooling the steel to a temperature of 550° C. to 750° C. at a cooling rate of 3° C./s to 20° C./s after annealing and then to a temperature of 200° C. or lower at a cooling rate of 100° C./s or higher.

However, the steel sheet disclosed in JP '619 is difficult to use for outer panels because a large amount of silicon needs to be added to form retained γ, thus degrading surface quality. To form retained γ, additionally, the steel sheet needs to be maintained in the temperature range of 350° C. to 500° C. for an extended period of time. This results in formation of a large amount of bainite which noticeably increases YP and therefore degrades surface distortion resistance, thus making it impossible to use the steel sheet as an outer panel.

The steel sheets disclosed in JP '405, JP '350, JP '036 and JP '816 above, on the other hand, are dual-phase steels having a microstructure composed mainly of ferrite and martensite formed by controlling the composition thereof such as the manganese, chromium, or molybdenum content, to achieve low YP, high elongation, and high BH.

However, it has been demonstrated that, of the steel sheets disclosed in JP '619, JP '405, JP '350, JP '036 and JP '816 above, those containing a large amount of chromium have low yield stress and little variation in material properties, whereas those containing a relatively small amount of chromium have high YP and large variations in material properties.

That is, dual-phase steels having a hard second phase such as martensite as a strengthening structure essentially tend to have variations in material properties as compared to conventional solid solution strengthened steels strengthened with manganese or phosphorus. For example, the volume fraction of the second phase varies noticeably with variations of several tens of ppm in the carbon content of the steel or variations of 20° C. to 50° C. in annealing temperature, and the material properties tend to vary with variation in second phase fraction. This makes it difficult to sufficiently reduce surface distortion of a dual-phase steel sheet.

It has also turned out that it is difficult to form uniform and fine conversion crystals on steels containing large amounts of chromium, molybdenum, and silicon after conversion treatment, where numerous voids where no conversion crystal is deposited (regions where no crystal is deposited after conversion treatment) are found, meaning that they have insufficient conversion treatment properties.

In addition, as a result of detailed research on the corrosion resistance of steel sheets containing a large amount of chromium in actual parts, we found that these steels have insufficient corrosion resistance at a hem of a hood or door or at a spot weld and that the perforation life of a steel decreases by about 1 year if 0.40% of chromium is added thereto and decreases by 2.5 years if 0.60% of chromium is added thereto. That is, while chromium is conventionally believed to have the effect of slightly improving the corrosion resistance in a flat panel atmospheric exposure environment, it has turned out that chromium noticeably degrades the corrosion resistance in an environment such as at stacked portions of steel sheets where the steel is exposed to a wet atmosphere for an extended period of time and a corrosion product accumulates easily, thus requiring the chromium content of steel sheets to be significantly reduced for such applications.

The technique disclosed in JP '294 is difficult to apply without water cooling equipment or air/water cooling equipment because it requires rapid cooling at 100° C./s or higher after annealing, and a sheet subjected to water cooling or air/water cooling cannot be used as an outer panel because the flatness decreases noticeably.

Thus, no dual-phase or multiphase steel has so far been provided that has a low YP comparable to the current level and excellent stability of mechanical properties, corrosion resistance, and conversion treatment properties, and there is a strong need for a steel combining these properties among automobile manufacturers.

Accordingly, it could be helpful to provide a high strength cold rolled steel sheet that solves the above problem and a method for manufacturing such a steel sheet.

SUMMARY

We conducted an intensive study for improving the conversion treatment properties and corrosion resistance of conventional dual-phase steel sheets with low yield strength and reducing variation in material properties within a coil or between coils and discovered the following on microstructure and composition:

(1) Conversion treatment properties sufficient for application to automotive outer panels can be achieved by controlling the total content of silicon, chromium, and molybdenum based on a weighted equivalent formula to a predetermined level, whereas sufficient corrosion resistance can be ensured by reducing the chromium content to less than 0.30% by mass and positively utilizing phosphorus.

(2) To reduce YP or YR and variation in YP within a coil or between coils, it is effective to form a multiphase structure including ferrite and a second phase composed mainly of martensite and retained γ while inhibiting formation of pearlite and bainite, to uniformly and coarsely disperse the second phase such that the average grain size of the second phase is 0.9 to 5 μm, and to control the proportion of retained γ in the second phase to 30% to 80%.

(3) The above steel structure can be formed by increasing an index of hardenability (manganese equivalent) of a steel containing manganese, chromium, molybdenum, vanadium, boron, and phosphorus, reducing the manganese and molybdenum contents while utilizing the following effects provided by phosphorus, and adjusting the cooling rate after annealing:

a. A great effect of improving the hardenability even with a trace amount of phosphorus added;

b. The effect of uniformly and coarsely dispersing the second phase at triple points of ferrite grain boundaries and the effect of conserving retained γ; and c. The effect of improving the corrosion resistance.

We thus provide:

(1) A high strength cold rolled steel sheet having a steel composition containing, in percent by mass, more than 0.015% to less than 0.100% of carbon, less than 0.40% of silicon, 1.0% to 1.9% of manganese, more than 0.015% to 0.05% of phosphorus, 0.03% or less of sulfur, 0.01% to 0.3% of soluble aluminum, 0.005% or less of nitrogen, less than 0.30% of chromium, less than 0.15% of molybdenum, 0.4% or less of vanadium, 0.02% or less of titanium, and 0.0050% or less of boron, and satisfying formula (1):

$$0.6[\%\ Si]+[\%\ Cr]+2[\%\ Mo]<0.35 \quad (1)$$

wherein [% A] is the content (% by mass) of alloying element A, the balance being iron and incidental impurities, the steel sheet having a microstructure that is a multiphase structure containing, in percent by volume, ferrite and 3% to 12% of a second phase, the multiphase structure containing, as the second phase, 1.0% to 10% of martensite and 1.0% to 5.0% of retained γ, wherein the total amount of martensite and retained γ in the second phase is 70% or more, the proportion of retained γ in the second phase is 30% to 80%, and the average grain size of the second phase is 0.9 to 5 μm.

(2) The high strength cold rolled steel sheet according to (1) above, further satisfying formulas (2) and (3):

$$2.0 \leq [Mneq] \leq 2.8 \quad (2)$$

$$[\%\ Mn]+3.3[\%\ Mo] \leq 1.9 \quad (3)$$

wherein [% A] is the content (% by mass) of alloying element A; and [Mneq]=[% Mn]+1.3[% Cr]+8[% P]+150B*+2[% V]+3.3[% Mo], wherein B*=[% B]+[% Ti]/48×10.8×0.9+[% sol.Al]/27×10.8×0.025, wherein if [% B]=0, B*=0, and if B*≥0.0022, B*=0.0022.

(3) The high strength cold rolled steel sheet according to (1) or (2) above, further satisfying formula (4):

$$0.42 \leq 12[\%\ P]+150B^* \leq 0.93 \quad (4)$$

wherein B*=[% B]+[% Ti]/48×10.8×0.9 +[% sol.Al]/27×10.8×0.025, wherein if [% B]=0, B*=0, and if B*≥0.0022, B*=0.0022; and [% A] is the content (% by mass) of alloying element A.

(4) The high strength cold rolled steel sheet according to one of (1) to (3) above, further satisfying formula (5):

$$0.49 \leq 12[\%\ P]+150B^* \leq 0.93 \quad (5)$$

wherein B*=[% B]+[% Ti]/48×10.8×0.9+[% sol.Al]/27×10.8×0.025, wherein if [% B]=0, B*=0, and if B*≥0.0022, B*=0.0022; and [% A] is the content (% by mass) of alloying element A.

(5) The high strength cold rolled steel sheet according to one of (1) to (4) above, further containing, in percent by mass, one or more of less than 0.02% of niobium, 0.15% or less of tungsten, 0.1% or less of zirconium, 0.5% or less of copper, 0.5% or less of nickel, 0.2% or less of tin, 0.2% or less of antimony, 0.01% or less of calcium, 0.01% or less of cerium, 0.01% or less of lanthanum, and 0.01% or less of magnesium.

(6) A method for manufacturing a high strength cold rolled steel sheet, including hot-rolling and cold-rolling a steel slab having the composition according to one of (1) to (5) above; annealing the steel sheet at an annealing temperature of 750° C. to 830° C.; subjecting the steel sheet to first cooling at an average cooling rate of 3° C./sec to 40° C./sec in the temperature range from the annealing temperature to 480° C.; subjecting the steel sheet to second cooling at an average cooling rate of 8° C./sec to 80° C./sec in the temperature range from 480° C. to Tc (° C.) given by formula (6):

$$Tc=435-40\times[\%\ Mn]-30\times[\%\ Cr]-30\times[\%\ V] \quad (6)$$

wherein [% A] is the content (% by mass) of alloying element A; and subjecting the steel sheet to third cooling at an average cooling rate of 0.3° C./sec to 30° C./sec in the temperature range from Tc (° C.) to 200° C.

A high strength cold rolled steel sheet having excellent conversion treatment properties and corrosion resistance, low YP, and little variation in material properties can be provided and it is suitable for increasing the strength and decreasing the thickness of automotive parts, and a method for manufacturing such a steel sheet, which is extremely useful industrially, can be also provided.

DETAILED DESCRIPTION

Figure 1:
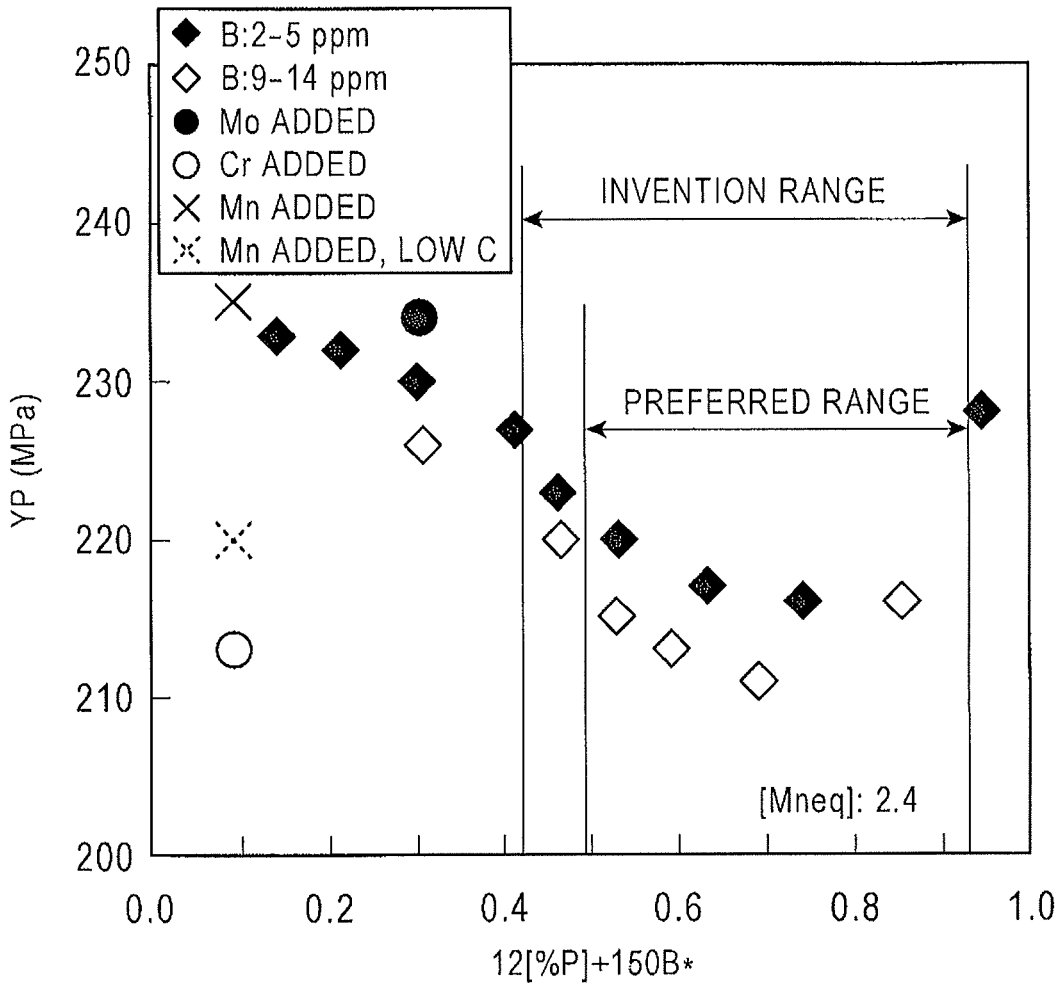
FIG. 1 is a graph showing the relationship between YP and 12P+150B*.

The composition and the microstructure are specified below.

(1) Composition (in the description, % refers to percent by mass)

Carbon: more than 0.015% to less than 0.100%

Carbon is an element necessary to ensure the desired volume fractions of the second phase and martensite. If the carbon content is low, no martensite forms, which makes it difficult to apply the steel sheet to outer panels because YP increases noticeably and a yield point elongation occurs.

In addition, YP varies greatly with varying annealing temperature. Furthermore, the properties characteristic of multiphase steels, including high BH and excellent anti-aging properties, are not achieved.

To ensure the desired volume fraction of martensite and achieve sufficiently low YP, the carbon content is more than 0.015%. In view of improving the anti-aging properties and further reducing YP and YR, the carbon content is preferably 0.020% or more.

On the other hand, if the carbon content is not less than 0.100%, the volume fractions of the second phase and martensite become excessively high, thus increasing YP and variation in material properties with varying annealing temperature and steel composition. In addition, the weldability deteriorates. Accordingly, the carbon content is less than 0.100%. To reduce YP and variation in material properties, the carbon content is preferably less than 0.060%, more preferably less than 0.040%.

Silicon: less than 0.40%

Silicon is added because a trace amount of silicon provides, for example, the effect of retarding scaling in hot rolling to improve surface appearance quality and the effect of forming a uniform and coarse microstructure in the steel sheet to reduce variation in material properties with varying annealing temperature and steel composition.

However, if silicon is added in an amount of not less than 0.40%, it degrades the surface appearance quality by causing a scale pattern which makes it difficult to apply the steel sheet to outer panels, and also increases YP. Accordingly, the silicon content is less than 0.40%.

The silicon content is preferably less than 0.30% to improve the surface quality and reduce YP and is more preferably less than 0.20% in view of achieving particularly excellent surface quality. In addition, as described later, the silicon content has to be controlled together with the chromium and molybdenum contents because it degrades conversion treatment properties.

Manganese: 1.0% to 1.9%

Manganese is added to increase hardenability and the proportion of martensite in the second phase. However, if the content exceeds 1.9%, the $\alpha \rightarrow \gamma$ transformation temperature in the annealing process decreases, thus causing γ grains to form at boundaries of fine ferrite grains immediately after recrystallization or at interfaces between recovered grains during recrystallization. This results in extended and non-uniformly dispersed ferrite grains and refined second phases, thus increasing YP.

In addition, because the refined second phases increase the amounts of variation in YP and TS per percent by volume of the second phase, YP and TS vary more as the fraction of the second phase varies with varying annealing temperature and steel composition such as carbon content, thus increasing variation in material properties within a coil or between coils.

On the other hand, if the manganese content is extremely low, it is difficult to ensure sufficient hardenability even if other elements are added in large amounts, and the corrosion resistance also deteriorates because MnS is finely dispersed in large numbers. To ensure sufficient hardenability and corrosion resistance, at least 1.0% of manganese needs to be added.

The manganese content is preferably 1.2% or more to further improve the corrosion resistance and is preferably 1.8% or less to further reduce YP and variation in material properties.

Phosphorus: more than 0.015% to 0.05%

Phosphorus is an important element to ensure excellent corrosion resistance and conversion treatment properties and reduce variation in material properties within a coil or between coils by forming retained γ while uniformly and coarsely forming the second phase. We found that if a steel containing a predetermined amount of phosphorus is moderately/mildly cooled after annealing and quickly cooled in the temperature range of 480° C. or lower, coarse retained γ forms, thus contributing to a reduction in YR and variation in material properties.

To achieve the effect of reducing the YR and variation in material properties and improving the corrosion resistance and conversion treatment properties by adding phosphorus, it needs to be added in an amount of at least more than 0.015%.

On the other hand, if phosphorus is added in an amount of more than 0.05%, low YP cannot be achieved because the effect of improving hardenability and the effect of forming a uniform and coarse microstructure become saturated and the solid solution strengthening effect becomes excessively large.

In addition, segregation occurs noticeably in casting, and wrinkle-like defects occur after pressing which makes it difficult to apply the steel sheet to outer panels. In addition, weldability deteriorates. Accordingly, the phosphorus content is 0.05% or less.

Sulfur: 0.03% or less

Sulfur can be contained because an appropriate amount of sulfur provides the effect of facilitating removal of primary scale from the steel sheet to improve the surface appearance quality. However, if the content is high, an excessive amount of MnS precipitates in the steel, thus decreasing the elongation and stretch-flangeability of the steel sheet.

In addition, hot ductility of slabs in hot rolling decreases, thus causing more surface defects, and the corrosion resistance also decreases slightly. Accordingly, the sulfur content is 0.03% or less. To improve stretch-flangeability and corrosion resistance, the sulfur content is preferably reduced within the range permitted in terms of manufacturing costs.

Soluble aluminum: 0.01% to 0.3%

Aluminum is added to reduce inclusions to ensure surface quality to the outer panel quality level and fix nitrogen to facilitate the effect of improving the hardenability provided by boron. Aluminum needs to be present as soluble aluminum in an amount of 0.01% or more, preferably 0.015% or more, to reduce defects due to inclusions to ensure surface quality to the outer panel quality level. More preferably, the soluble aluminum content is 0.04% or more in view of fixing nitrogen to improve the hardenability of boron.

On the other hand, if aluminum is present in an amount more than 0.3%, coarse AlN precipitates in casting, thus degrading castability and therefore the surface quality, which makes it difficult to use the steel sheet as an outer panel. Accordingly, the soluble aluminum content is 0.3% or less. To ensure further excellent surface quality, the soluble aluminum content is preferably 0.2% or less.

Nitrogen: 0.005% or less

Nitrogen, which is an element that forms nitrides such as CrN, BN, AlN, and TiN in the steel, refines ferrite grains and second phases by forming CrN and AlN, thus increasing YP. In addition, nitrogen forms BN in a boron-containing steel, with the result that the effect of reducing YP by adding boron disappears.

If the nitrogen content exceeds 0.005%, YP increases, and the effect provided by adding boron disappears. Accordingly, the nitrogen content is 0.005% or less. In view of reducing YP, the nitrogen content is preferably 0.004% or less.

Chromium: less than 0.30%

Chromium, which is an important element, has the effect of reducing variation in material properties, although it has the effect of degrading corrosion resistance and conversion treatment properties at a hem. The chromium content is less than 0.30% to avoid degradation of corrosion resistance and conversion treatment properties at a hem. To improve corrosion resistance, the chromium content is preferably less than 0.25%. Chromium is an element that can be optionally added in adjusting [Mneq], shown below, to form martensite. Although the lower limit is not specified (including 0% of chromium), it is preferably added in an amount of 0.02% or more, more preferably 0.05% or more, in view of reducing YP.

Molybdenum: less than 0.15% (including 0%); vanadium: 0.4% or less (including 0%);

titanium: 0.02% or less (including 0%); boron: 0.0050% or less (including 0%)

Molybdenum is added to improve hardenability to inhibit formation of pearlite, thus reducing YR and increasing BH. However, an excessive amount of molybdenum noticeably increases YP and increases variation in material properties because it has a great effect of refining second phases and ferrite grains.

In addition, molybdenum is an extremely expensive element and also noticeably degrades conversion treatment properties. Accordingly, the molybdenum content is limited to less than 0.15% (including 0%) to reduce YP and variation in material properties, reducing the cost, and improving the conversion treatment properties. To further reduce YP, the molybdenum content is preferably 0.05% or less. More preferably, no molybdenum is added (0.02% or less).

Vanadium, which is an element that improves hardenability, can be used as an alternative to manganese, molybdenum, and chromium because it hardly affects YP or variation in material properties and has little effect on degrading surface quality, corrosion resistance, and conversion treatment properties. From the above viewpoint, vanadium is preferably added in an amount of 0.002% or more, more preferably 0.01% or more. The vanadium content, however, is not more than 0.4% (including 0%) because it is extremely expensive and noticeably increases the cost if the content exceeds 0.4%.

Titanium, which has the effect of fixing nitrogen to improve the hardenability of boron, improve anti-aging properties, and improve castability, is added to supplementarily achieve these effects.

If the titanium content is high, however, it has the effect of noticeably increasing YP by forming fine precipitates such as TiC and Ti(C,N) in the steel, and also has the effect of decreasing BH by forming TiC during cooling after annealing. If titanium is added, therefore, the amount thereof is 0.02%. The titanium content may be 0%, although it is preferably 0.002% or more to improve the hardenability of boron by precipitating TiN to fix nitrogen and is preferably 0.010% or less to inhibit precipitation of TiC to achieve low YP.

Boron forms uniform and coarse ferrite grains and martensite and improves hardenability to inhibit pearlite. Therefore, if manganese is replaced with boron while ensuring a predetermined [Mneq], described later, it reduces YP and variation in material properties, as does phosphorus. The boron content, however, is 0.0050% or less (including 0%) because a content exceeding 0.005% noticeably decreases castability and rollability. To produce the effect of reducing YP and variation in material properties, boron is preferably added in an amount of 0.0002% or more, more preferably more than 0.0010%.

0.6[% Si]+[% Cr]+2[% Mo]: less than 0.35 where [% A] is the content (% by mass) of alloying element A This parameter formula serves as an index of conversion treatment properties, and the value thereof is less than 0.35 to improve conversion treatment properties so that the steel sheet can be applied to automotive outer panels. If the value is not less than 0.35, oxides, for example, that hinder deposition of conversion crystals form on the surface of the steel sheet, and numerous voids where no conversion crystal is deposited are found because the nuclei of the conversion crystals are not uniformly or finely formed. Such a steel sheet exhibits insufficient corrosion resistance in a corrosion resistance evaluation in which a cross cut reaching the steel sheet is made after conversion treatment. In contrast, steels having values of less than 0.35 had uniform and fine conversion crystals formed thereon, and steel sheets on which a cross cut was made exhibited good corrosion resistance.

[Mneq]: 2.0 to 2.8

[Mneq] (manganese equivalent formula) is an index of the effect of improving hardenability by various elements including manganese, chromium, molybdenum, vanadium, boron, and phosphorus, in a CAL thermal history where mild cooling is performed after annealing. To stably reduce fine pearlite or bainite, [Mneq] is preferably 2.0 to 2.8.

If [Mneq] is 2.0 or more, formation of pearlite and bainite is sufficiently inhibited in a CAL heat cycle where mild cooling is performed after annealing, and variation in material properties with varying annealing temperature is reduced. To further reduce YP and variation in material properties, [Mneq] is preferably 2.2 or more, more preferably 2.4 or more.

If [Mneq] exceeds 2.8, on the other hand, it is difficult to ensure a predetermined volume fraction of retained γ because carbon concentrates insufficiently in γ as a result of inhibited γ→α transformation during cooling, and the amounts of manganese, molybdenum, chromium, and phosphorus added are excessively large, thus making it difficult to ensure sufficiently low YP and excellent corrosion resistance at the same time.

$$[Mneq]=[\%\ Mn]+1.3[\%\ Cr]+8[\%\ P]+150B^*+2[\%V]+3.3[\%\ Mo],$$ where $B^*=[\%\ B]+[\%\ Ti]/48\times10.8\times0.9+[\%\ sol.Al]/27\times10.8\times0.025$. If [% B]=0, B*=0, and if B*≥0.0022, B*=0.0022.

B* is an index of the effect of conserving dissolved carbon by adding boron, titanium, and aluminum to improve the hardenability. For a boron-free steel, B*=0 because the effect provided by adding boron is not available. If B* is 0.0022 or more, on the other hand, B* is 0.0022 because the effect of improving the hardenability by boron becomes saturated.

[% Mn], [% Cr], [% P], [% B], [% V], [% Mo], [% Ti], and [% sol.Al] are the contents of manganese, chromium, phosphorus, boron, vanadium, molybdenum, titanium, and soluble aluminum, respectively.

$$[\%\ Mn]+3.3[\%\ Mo]\leq1.9$$

This parameter formula is a weighted equivalent formula for the manganese and molybdenum contents to reduce YP and variation in material properties. The value of the parameter formula is preferably 1.9 or less because a value of more than 1.9 results in an increase in YP and variation in material properties.

$$0.42\leq12[\%\ P]+150B^*\leq0.93$$

This parameter formula is a weighted equivalent formula of the phosphorus content and B* for the phosphorus and boron contents to uniformly and coarsely disperse the second phase, ensure a predetermined amount of retained γ, and thereby reduce YP and the amount of variation in material properties. The amount of retained γ formed increases with increasing value of the parameter formula.

The value of the parameter formula is preferably 0.42 or more because a value of less than 0.42 results in high YP and a large amount of variation in material properties. If the value exceeds 0.93, on the other hand, phosphorus needs to be added in an amount of more than 0.05%. This reduces variation in material properties, but makes it impossible to achieve sufficiently low YP because of excessive solid solution strengthening with phosphorus. Accordingly, the value is preferably 0.93 or less, more preferably 0.49 to 0.93.

Figure 2:
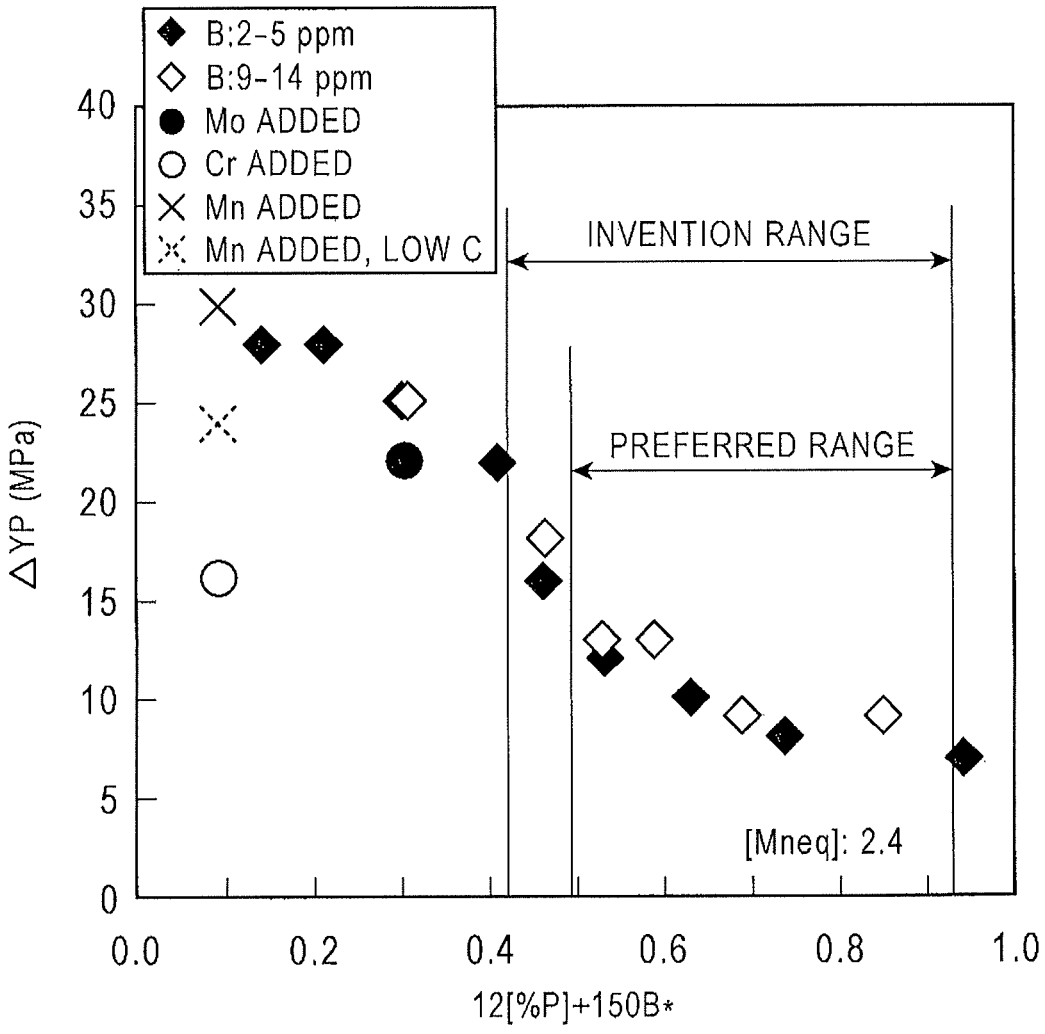
FIG. 2 is a graph showing the relationship between the amount of variation in YP (ΔYP) with annealing temperature and 12P+150B*.

FIGS. 1 and 2 show the effect of the parameter formula on variation in material properties. FIG. 1 is a graph showing the relationship between YP of steel sheets temper-rolled after annealing (phosphorus-containing steels, where ♦ indicates those containing 0.0002% to 0.0005% of boron, and ◇ indicates those containing 0.0009% to 0.0014% of boron) and the parameter formula. As an evaluation of variation in the material properties of the steel sheets used in FIG. 1, FIG. 2 is a graph showing the relationship between the amount of variation in YP, ΔYP, of cold-rolled sheets with a variation in annealing temperature of 50° C. in the range of 770° C. to 820° C. and the parameter formula, According to FIGS. 1 and 2, if 12[% P]+150B* is 0.42 or more, YP is low, and variation in YP, ΔYP, with annealing temperature decreases noticeably. In addition, if 12[% P]+150B* is 0.49 or more, variation in material properties decreases further while YP remains low.

YP was lower than or similar to the steels (x) based on manganese and the steel (●) containing molybdenum and was nearly as low as that of the steel (○) containing chromium. Variation in material properties ΔYP was smaller than those of the steels based on manganese and the steel containing molybdenum and was smaller than or similar to that of the steel containing chromium. The above steels had strengths TS of 446 to 461 MPa.

Figure 3:
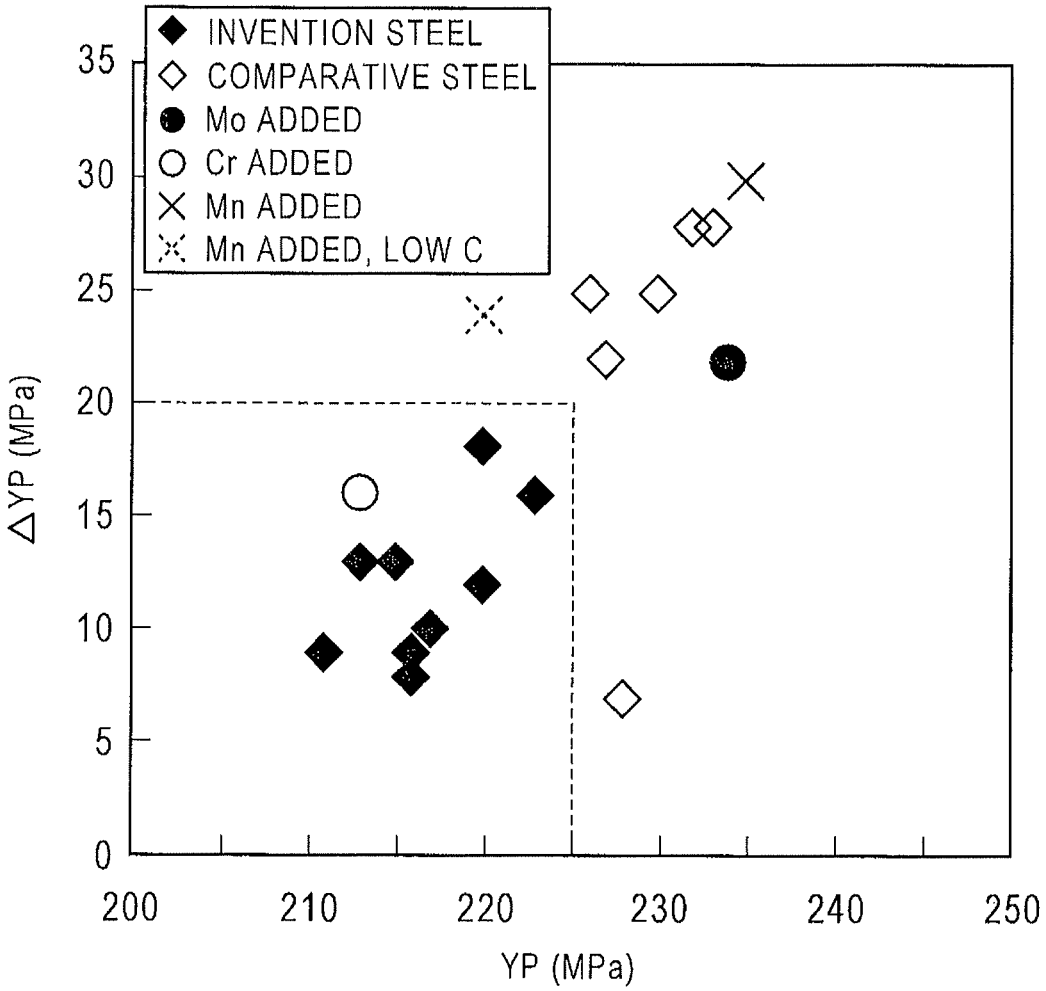
FIG. 3 is a graph showing the relationship between YP and the amount of variation in YP (ΔYP) of various steel sheets.

In addition, FIG. 3 shows the relationship between YP and ΔYP of the steels. In FIG. 3, ♦ indicates our steels, and ◇ indicates comparative steels other than the steels (x) based on manganese, the steel (●) containing molybdenum, and the steel (○) containing chromium. FIG. 3 shows that our steels were low in both YP and ΔYP. The steels other than the steel containing chromium were high in YP or ΔYP, or both.

The results shown are test results obtained in the following manner.

The steels under test were prepared by melting in a vacuum steels containing 0.025% of carbon, 0.01% of silicon, 1.5% to 2,2% of manganese, 0.002% to 0.065% of phosphorus, 0.003% of sulfur, 0.06% of soluble aluminum, 0.10% of chromium, 0.003% of nitrogen, and 0.0002% to 0.0014% of boron and having the manganese, phosphorus, and boron contents thereof adjusted such that [Mneq] was substantially 2.4.

The comparative steels were prepared together by melting manganese-based composition steels containing 0.015% or 0.022% of carbon, 0.008% of phosphorus, no boron, no chromium, and 2.34% of manganese; a chromium-containing composition steel containing 0.008% of phosphorus, no boron, 1.8% of manganese, and 0.40% of chromium; and a molybdenum-containing composition steel containing 0.008% of phosphorus, 0.0008% of boron, 1.6% of manganese, no chromium, and 0.17% of molybdenum.

Slabs having a thickness of 27 mm were cut from the resulting ingots, were heated to 1,200° C., were hot-rolled to a thickness of 2.8 mm at a finish rolling temperature of 870° C., were cooled to 620° C. by water spraying immediately after the rolling, were forcedly air-cooled to 570° C. at 4° C./sec using a blower, and were coiled at 570° C. for a holding time of one hour.

The resulting hot-rolled sheets were cold-rolled to a thickness of 0.75 mm at a rolling reduction of 73%. The resulting cold-rolled sheets were annealed by heating the steel sheets at an average heating rate of 1.8° C./sec in the temperature range of 680° C. to 740° C. and then soaking the steel sheets at 775° C. to 785° C. for 40 seconds, and were subjected to first cooling from the annealing temperature to 480° C. at an average heating rate of 10° C./sec. Subsequently, the steel sheets were rapidly cooled from 480° C. to 300° C. such that the average cooling rate from 480° C. to TC, represented by formula (6), was 20° C./sec. The steel sheets were further subjected to third cooling from Tc to 200° C. at an average cooling rate of 0.5° C./sec to 1° C./sec. Thereafter, the steel sheets were cooled to room temperature at 20° C./sec.

The resulting annealed sheets were temper-rolled to an elongation of 0.1%. JIS No. 5 tensile test pieces were taken from the resulting steel sheets and subjected to a tensile test (according to JIS Z2241).

Shown above is our basic composition, and the balance is iron and incidental impurities. To improve selected properties, the composition may further contain at least one of niobium, tungsten, zirconium, copper, nickel, tin, antimony, calcium, cerium, lanthanum, and magnesium, as shown below.

Niobium: less than 0.02%

Niobium can be added to increase strength because it has the effect of forming a finer microstructure and precipitating NbC and Nb(C,N) to strengthen the steel sheet. From the above viewpoint, niobium is preferably added in an amount of 0.002% or more, more preferably 0.005% or more. The niobium content, however, is preferably less than 0.02% because YP increases noticeably if the content is not less than 0.02%, Tungsten: 0.15% or less Tungsten can be used as a hardening element and a precipitation-strengthening element. From the above viewpoint, tungsten is preferably added in an amount of 0.002% or more, more preferably 0.005% or more. The tungsten content, however, is preferably 0.15% or less because an excessive content increases YP.

Zirconium: 0.1% or less

Zirconium can also be used as a hardening element and a precipitation-strengthening element. From the above viewpoint, zirconium is preferably added in an amount of 0.002% or more, more preferably 0.005% or more. The zirconium content, however, is preferably 0.1% or less because an excessive content increases YP.

Copper: 0.5% or less

Copper is preferably added to improve corrosion resistance. In addition, copper is an element contained in scrap materials. If copper is tolerated, recycled materials can be used as a raw material to reduce manufacturing costs.

To improve corrosion resistance, copper is preferably added in an amount of 0.01% or more, more preferably 0.03% or more. The copper content, however, is preferably 0.5% or less because an excessive content results in surface defects.

Nickel: 0.5% or less

Nickel is also an element having the effect of improving corrosion resistance. In addition, nickel reduces surface defects which tend to occur if copper is present. Accordingly, if nickel is added to improve corrosion resistance and surface quality, it is preferably added in an amount of 0.02% or more. However, an excessive nickel content results in surface defects due to uneven scaling in a heating furnace and noticeably increases the cost. Accordingly, if nickel is added, the content thereof is 0.5% or less.

Tin: 0.2% or less

Tin is preferably added to inhibit nitriding and oxidation of the surface of the steel sheet or decarburization and deboronation due to oxidation in a region extending several tens of microns from the surface of the steel sheet. This improves, for example, fatigue properties, anti-aging properties, and surface quality. To inhibit nitriding and oxidation, tin is preferably added in an amount of 0.005% or more. The tin content, however, is preferably 0.2% or less because a content of more than 0.2% increases YP and degrades toughness.

Antimony: 0.2% or less

As with tin, antimony is preferably added to inhibit nitriding and oxidation of the surface of the steel sheet or decarburization and deboronation due to oxidation in a region extending several tens of microns from the surface of the steel sheet. Inhibiting such nitriding and oxidation prevents a decrease in the amount of martensite formed in the surface layer of the steel sheet and a decrease in hardenability due to decreased boron content, thus improving the fatigue properties and the anti-aging properties. To inhibit nitriding and oxidation, antimony is preferably added in an amount of 0.005% or more. The antimony content, however, is preferably 0.2% or less because a content of more than 0.2% increases YP and degrades the toughness.

Calcium: 0.01% or less

Calcium fixes sulfur in the steel as CaS and increase pH in a corrosion product to improve corrosion resistance at a hem or the periphery of a spot weld. By forming CaS, additionally, calcium inhibits formation of MnS which decreases stretch-flangeability, thus improving stretch-flangeability. From these viewpoints, calcium is preferably added in an amount of 0.0005% or more. If calcium is added, however, the content thereof is 0.01% or less because it tends to float and separate as oxides in molten steel and is therefore difficult to leave in large amounts in the steel.

Cerium: 0.01% or less

Cerium can also be added to fix sulfur in the steel to improve corrosion resistance and stretch-flangeability. From the above viewpoint, cerium is preferably added in an amount of 0.0005% or more. However, a large amount of cerium added increases the cost because it is an expensive element. Accordingly, cerium is preferably added in an amount of 0.01% or less.

Lanthanum: 0.01% or less

Lanthanum can also be added to fix sulfur in the steel to improve corrosion resistance and stretch-flangeability. From the above viewpoint, lanthanum is preferably added in an amount of 0.0005% or more. However, a large amount of lanthanum added increases the cost because it is an expensive element. Accordingly, lanthanum is preferably added in an amount of 0.01% or less.

Magnesium: 0.01% or less

Magnesium can be added to finely disperse oxides to form a uniform microstructure. From the above viewpoint, magnesium is preferably added in an amount of 0.0005% or more. However, magnesium is preferably added in an amount of 0.01% or less because a high content degrades the surface quality.

(2) Microstructure

The microstructure is a multiphase structure containing ferrite and 3% to 12% by volume of a second phase and, as the second phase, the multiphase structure contains 1.0% to 10% by volume of martensite and 1.0% to 5.0% by volume of retained γ. Uniform and coarse ferrite grains and second phases are formed to reduce variation in material properties with varying volume fraction of the second phase, thus reducing variation in material properties within a coil or between coils. In addition, most of the second phases are dispersed at triple points where boundaries between the ferrite grains meet each other.

Pearlite and bainite are reduced in the microstructure because a multiphase steel sheet having pearlite or bainite formed therein has high YP. It is difficult to distinguish pearlite and bainite from martensite in a multiphase steel sheet by optical microscopy because they are fine, namely, about 1 to 2 μm in size, and are adjacent to martensite. They can be distinguished by SEM at a magnification of 3,000 times or more.

For example, in detailed microstructure examination of a conventional 0.03% C-1.5% Mn-0.5% Cr steel, only coarse pearlite is recognized by optical microscopy or SEM at a magnification of about 1,000 times, and the volume fraction of pearlite or bainite in the second phase is measured to be about 10%. In detailed examination by SEM at a magnification of 4,000 times, on the other hand, the volume fraction of pearlite or bainite in the second phase accounts for 30% to 40%. Formation of such pearlite or bainite can be inhibited to achieve low YP at the same time.

In addition, the total volume fraction of martensite and retained γ in the second phase is 70% or more, and the volume fraction of retained γ in the second phase is 30% to 80%. Volume fraction of second phase: 3% to 12%

To achieve high BH and excellent anti-aging properties while achieving low YP, the volume fraction of the second phase needs to be 3% or more. However, a volume fraction of the second phase exceeding 12% increases YP and variation in material properties with annealing temperature.

Accordingly, the volume fraction of the second phase is 3% to 12%. To reduce variation in material properties while achieving lower YP, the volume fraction of the second phase is preferably 10% or less, more preferably 8% or less, and still more preferably 6% or less.

Volume fraction of martensite: 1.0% to 10%

To achieve high BH and excellent anti-aging properties while achieving low YP, the volume fraction of martensite needs to be 1.0% or more. However, a volume fraction of martensite exceeding 10% increases YP and variation in material properties with annealing temperature.

Accordingly, the volume fraction of martensite is 1.0% to 10%. To reduce variation in material properties while achieving lower YP, the volume fraction of martensite is preferably 8% or less, more preferably 6% or less.

Volume fraction of retained γ: 1.0% to 5.0%

Retained γ is an important microstructure. That is, retained γ is relatively coarsely formed because the steel composition and the cooling rate in CAL are adjusted. In addition, retained γ is softer than martensite and bainite and has no hardening strain formed around martensite.

As a result, it has turned out that the formed retained γ has an extremely smaller effect of increasing YP than, for example, martensite and bainite, and YP hardly varies with a variation of several percent in the volume fraction thereof.

On the other hand, retained γ transforms into martensite when subjected to plastic deformation, thus increasing the strength. Thus, it has turned out that a steel having a high proportion of retained γ formed in the second phase has a lower YR than a steel of the same TS level, and a steel sheet having a high proportion of retained γ formed therein has little variation in YP as the fraction of the second phase varies with varying steel composition or annealing temperature.

To achieve the above effect of retained γ, the volume fraction of retained γ needs to be at least 1.0%. On the other hand, a volume fraction of retained γ exceeding 5.0% increases YP because a sufficient amount of martensite in the second phase cannot be ensured. Accordingly, the volume fraction of retained γ is 1.0% to 5.0%. To reduce variation in material properties, the volume fraction of retained γ is 2% or more.

Ratio of total volume fraction of martensite and retained γ to that of second phase: 70% or more YP increases if pearlite and bainite are formed. Conventional steels using retained γ have extremely high YP because a large amount of bainite is formed therein. YR can be reduced by forming retained γ while reducing bainite. To ensure low YP by sufficiently inhibiting formation of pearlite and bainite, the ratio of total volume fraction of martensite and retained γ to the volume fraction of second phase needs to be 70% or more.

Volume fraction of retained γ in second phase: 30% to 80%

As described above, a steel having a high proportion of retained γ formed in the second phase has little variation in YP as the fraction of the second phase varies with varying steel composition or annealing temperature because martensite and bainite which have the effect of increasing YP as the volume fractions thereof increase, are contained only in low proportions.

This effect can be achieved by controlling the volume fraction of retained γ in the second phase to 30% or more. On the other hand, an excessive volume fraction of retained γ in the second phase results in an extremely low volume fraction of martensite which is necessary to reduce YP, thus increasing YP and variation in YP with varying steel composition or annealing temperature.

Accordingly, the volume fraction of retained γ in the second phase is 30% to 80%. To further reduce variation in material properties, the volume fraction of retained γ in the second phase is preferably 40% to 70%.

Average grain size of second phase: 0.9 to 5 μm

To reduce YP and variation in YP with varying steel composition such as carbon or manganese content, or annealing temperature, the average grain size of the second phase is 0.9 to 5 μm. This reduces the amount of increase in YP per percent of the volume of the second phase, thus reducing variation in material properties. On the other hand, an average grain size of the second phase exceeding 5 μm results in an extremely small number of second phases relative to the number of ferrite grains, thus making it impossible to reduce YP. Accordingly, the average grain size of the second phase is 0.9 to 5 μm.

These forms of microstructures are achieved by adjusting the manganese, molybdenum, chromium, phosphorus, and boron contents and the cooling conditions in annealing. The methods for examining these forms of microstructures are as follows.

The volume fraction of the second phase was determined by corroding an L-cross section of a steel sheet (vertical cross section parallel to the rolling direction) with nital after polishing, observing ten fields of view by SEM at a magnification of 4,000 times, and subjecting the captured microstructure photographs to image analysis to measure the area ratio of the second phase.

That is, the area ratio of the second phase measured in an L-cross section was used as the volume fraction of the second phase because our steel sheets had little difference in the form of microstructure between the rolling direction and the direction perpendicular to the rolling direction and the area ratios of the second phase measured in both directions were substantially the same.

In the microstructure photographs, dark contrast regions were determined to be ferrite, regions where carbides were formed in a lamellar or dot pattern were determined to be pearlite or bainite, and grains contrasted in white were determined to be martensite or retained γ.

The volume fraction of martensite and retained γ was determined by measuring the area ratio of the white contrast regions. The fine dot-like grains of diameters of 0.4 μm or less found in the SEM photographs, which were determined to be mainly carbides by TEM, were excluded from the evaluation of the volume fraction because they had an extremely small area ratio and were therefore considered to have little effect on the material properties. Accordingly, the volume fraction was determined based on the grains contrasted in white, which were martensite and retained γ, and the microstructure including a lamellar or dot pattern of carbides, which was pearlite and bainite. The volume fraction of the second phase refers to the total amount of these microstructures.

In a cooling process after continuous annealing, martensite formed at about 350° C. or lower may be slightly tempered if the cooling rate in that temperature range is low. This slightly tempered martensite was regarded as martensite. Tempered martensite is distinguished from bainite as follows. That is, because carbides in tempered martensite are much more finely dispersed than carbides dispersed in bainite, they can be distinguished by measuring the average grain size of the carbides dispersed in the individual martensite grains and bainite grains. Grains containing carbides having an average grain size of 0.15 μm or less were determined to be tempered martensite, and those containing carbides having an average grain size of more than 0.15 μm were determined to be bainite.

The volume fraction of retained γ was determined by measuring the integrated intensities of the {200}, {211}, and {220} planes of α and at the {200}, {220}, and {311} planes of γ by X-ray diffraction at a scan speed of 0.1° /min using Co-Kα radiation as the X-ray source on a surface formed by reducing the thickness of the steel sheet by one fourth, calculating the volume fraction of retained γ for each combination from the resulting integrated intensities of the individual planes, and calculating the average thereof.

The volume fraction of martensite was determined by subtracting the volume fraction of retained γ determined by X-ray diffraction from the volume fraction of martensite and retained γ determined by SEM above.

For spherical grains, the diameter thereof was used as the average grain size. For grains elliptical in the SEM images, the major axis a and the minor axis b perpendicular thereto were measured, and $(a \times b)^{0.5}$ was calculated as the equivalent grain size. Rectangular grains were treated in the same manner as elliptical grains. That is, the grain size thereof was determined based on the above expression by measuring the major and minor axes.

Two adjacent second phases were separately counted if the contact portion partially had the same width as the grain boundary, and were counted as one grain if the contact portion was wider than the grain boundary, that is, had a certain width. However, if different types of second phases are formed in contact with each other, for example, if martensite and pearlite or martensite and bainite are adjacent, the average particle sizes thereof were determined as separate grains. Preferred conditions for manufacturing a steel sheet having the above microstructure will now be described.

(3) Manufacturing Conditions

A steel slab having the above composition is hot-rolled and cold-rolled in a usual manner, is annealed in a continuous annealing line (CAL), and is subjected to first to third cooling.

Hot Rolling

Hot rolling may be carried out in a usual manner, for example, at a slab heating temperature of 1,100° C. to 1,300° C., a finish rolling temperature of $Ar_3$ transformation point to $Ar_3$ transformation point +150° C., and a coiling temperature of 400° C. to 720° C. To reduce the planar anisotropy of r-value and improve BH, the cooling rate after hot rolling is preferably 20° C./sec or higher, and the coiling temperature is preferably 600° C. or lower.

To achieve excellent surface quality for outer panels, it is preferable that the slab heating temperature be 1,250° C. or lower, descaling be sufficiently performed to remove primary and secondary scales formed on the surface of the steel sheet, and the finish rolling temperature be 900° C. or lower.

Cold Rolling

In cold rolling, the rolling reduction may be 50% to 85%. Preferably, the rolling reduction is 65% to 73% to improve the r-value for higher deep-drawability and is 70% to 85% to reduce planar anisotropy of the r-value and YP.

Annealing

The cold-rolled steel sheet is annealed in CAL. To reduce YP and variation in material properties with varying annealing temperature and steel composition, the average heating rate from 680° C. to 750° C. in annealing is preferably 7° C./sec or lower. If the heating rate exceeds 7° C./sec, the second phase is unevenly and finely dispersed, thus increasing the amounts of variation in YP and TS with varying fraction of the second phase.

The annealing temperature is 750° C. to 830° C. If the annealing temperature falls below 750° C., a sufficient volume fraction of the second phase cannot be stably ensured because dissolution of carbides is insufficient. If the annealing temperature exceeds 830° C., sufficiently low YP cannot be achieved because more pearlite and bainite form and an excessive amount of retained γ forms.

As in typical continuous annealing, the soaking time may be 20 to 200 seconds, preferably 40 to 200 seconds, for the temperature range of 750° C. or higher.

Average cooling rate in temperature range from annealing temperature to 480° C. (first cooling rate): 3° C./sec to 40° C./sec To ensure a predetermined volume fraction of retained γ by concentrating manganese and carbon in γ grains while inhibiting formation of pearlite during cooling to reduce YP and variation in YP, the average cooling rate in the temperature range from the annealing temperature to 480° C. needs to be 3° C./sec to 40° C./sec.

Average cooling rate in range from 480° C. to Tc (° C.) (second cooling rate): 8° C./sec to 80° C./sec where Tc=435−40×[% Mn]−30×[% Cr]−30×[% V] ([% A] is the content (% by mass) of alloying element A In the temperature range from 480° C. to Tc, bainite, which is fine and hard, tends to form, and formation of bainite involves formation of carbides from γ remaining in the steel which does not contain a large amount of silicon or aluminum, thus decreasing the volume fraction of retained γ. This increases YP and variation in YP.

In the temperature range of 480° C. or lower, therefore, with the rapid cooling stop temperature being lower than or equal to Tc, the steel sheet needs to be rapidly cooled such that the average cooling rate in the temperature range from 480° C. to Tc is 8° C./sec to 80° C./sec.

On the other hand, if the average cooling rate in second cooling exceeds 80° C./sec, the cooled sheet has poor flatness. Accordingly, the second cooling rate is 8° C./sec to 80° C./sec.

To further reduce the amount of bainite formed to increase the amount of retained γ formed, the cooling rate in the temperature range from 480° C. to Tc is preferably 10° C./sec or higher.

Average cooling rate in temperature range from Tc (° C.) to 200° C. (third cooling rate): 0.3° C./sec to 30° C./sec If the average cooling rate in the temperature range from Tc (° C.) to 200° C. is 0.3° C./sec to 30° C./sec, excess dissolved carbon remaining in ferrite and martensite can be precipitated to reduce YP and increase elongation.

The high strength cold rolled steel sheet manufactured by the manufacturing method described above can be used as it is as a steel sheet for press-forming because YPE1 falls below 0.5% in the as-annealed state and YP is sufficiently low.

However, skin-pass rolling may be carried out to stabilize press-formability such as by adjusting the surface roughness and making the sheet flat. Because skin-pass rolling increases YP by about 5 to 7 MPa per 0.1% elongation, elongation in skin-pass rolling is preferably 0.1% to 0.6% to achieve low YP, high El, and high WH.

EXAMPLES

The steels of the compositions shown in Tables 1 and 2 were prepared, continuously cast into slabs having a thickness of 230 mm, heated to 1,180° C. to 1,250° C., and hot-rolled at a finish rolling temperature of 820° C. to 900° C. The hot-rolled sheets were then cooled to 640° C. or lower at an average cooling rate of 20° C./sec to 40° C./sec and coiled at a coiling temperature CT of 400° C. to 630° C. The resulting hot-rolled sheets were cold-rolled to a rolling reduction of 68% to 78% to form cold-rolled sheets having a thickness of 0.8 mm.

The resulting cold-rolled sheets were heated in CAL such, that the average heating rate in the heating temperature range from 680° C. to 750° C. was 0.9° C./sec to 15° C./sec, annealed at the annealing temperature AT shown in Tables 3 and 4 for 40 seconds, subjected to first cooling from the annealing temperature AT to 480° C., second cooling from 480° C. to Tc, represented by formula (6) above, and third cooling from Tc to 200° C., and cooled to room temperature at a cooling rate of 10° C./sec to 30° C./sec. First to third cooling was specified by the average cooling rate. The rapid cooling stop temperature in the temperature range of 480° C. or lower was in the range of 258° C. to 425° C.

The resulting cold-rolled steel sheets were temper-rolled to an elongation of 0.1%, and samples taken therefrom and examined for the volume fraction of the second phase, the volume fraction of martensite, the volume fraction of retained γ, the ratio of volume fraction of martensite and retained γ relative to the volume fraction of the second phase (the proportion of martensite and retained γ in the second phase), the ratio of volume fraction of retained γ relative to the volume fraction of the second phase (the proportion of retained γ in the second phase), and the average particle size of the second phase by the methods described above.

In addition, the types of steel structures were distinguished by SEM. Furthermore, JIS No. 5 test pieces were taken in the rolling direction and the direction perpendicular thereto and were evaluated for YP and TS by a tensile test (according to JIS Z2241).

In addition, each steel was examined for the amount of variation in YP, ΔYP, with varying annealing temperature in the range of 770° C. to 820° C.

In addition, each steel was evaluated for corrosion resistance using an assembly that simulated a hem or the periphery of a spot weld. Specifically, two steel sheets were stacked and spot-welded such that they closely contacted each other, subjected to conversion treatment with zinc phosphate and electrodeposition coating, and subjected to a corrosion test under the SAE J2334 corrosion cycle conditions.

The thickness of the electrodeposition coating was 25 μm. After 30 cycles elapsed, corrosion product was removed from the corroded samples, and the reduction in thickness from the original thickness measured in advance was determined as the corrosion loss.

In addition, test pieces having a size of the thickness×75 mm×150 mm were subjected to conversion treatment with zinc phosphate and electrodeposition coating to a coating thickness of 25 μm, cut with a utility knife to make two cuts 100 mm long and deep enough to reach the steel sheets, and immersed in a 5% NaCl solution at 50° C. for 240 hours, and adhesive tape was stuck on the cuts and removed to measure the peel width of the coating.

The steel sheets were determined to have good conversion treatment properties (denoted as "Good") if the maximum peel width of coating peeling, that occurred on both sides of the cross cut, on one side thereof was 2.5 mm or less, and determined to have poor conversion treatment properties (denoted as "Poor") if it exceeded 2.5 mm.

Tables 3 and 4 show the manufacturing conditions and the test results. Our steel sheets (Steel Sheet Nos. 2, 3, 5, 6, 7, 11, 12, 14, 15, 16, 18, 19, 20, 21, 24 to 35, and 58 to 65) had a higher corrosion resistance with a significantly lower corrosion loss at stacked portions of steel sheets, and also had a higher corrosion resistance after conversion treatment, than conventional steel sheets of the Comparative Examples (Steel Sheet Nos. 1, 4, 8, 9, 10, 13, 17, 22, 23, and 36 to 57), which had an inappropriate silicon, molybdenum, or chromium content or annealing conditions.

In addition, our steel sheets (Steel Sheet Nos. 2, 3, 5, 6, 7, 11, 12, 14, 15, 16, 18, 19, 20, 21, 24 to 35, and 58 to 65), which had appropriate phosphorus and boron contents and annealing conditions, had an appropriate steel structure despite the reduced contents of the added elements. Our steel sheets had lower or similar YPs for the same TS level, that is, lower YRs, and significantly smaller variations in material properties than the conventional steel sheets having an inappropriate steel composition or steel structure.

Specifically, steels V, W, and X, which were conventional steels containing large amounts of chromium, had high corrosion losses, namely, 0.44 to 0.80 mm. In particular, steel W, which contained 0.60% of chromium, had extremely poor corrosion resistance because a hole was formed through the sheet. In contrast, our steel sheets had corrosion losses of 0.20 to 0.38 mm, indicating that they had a significantly higher corrosion resistance.

Although not shown in the tables, conventional 340BH (hereinafter referred to as "conventional steel") was also evaluated for corrosion resistance, and the corrosion loss was 0.33 to 0.36 mm. The chemical composition of the conventional steel was as follows: 0.002% of carbon, 0.01% of silicon, 0.4% of manganese, 0.05% of phosphorus, 0.008% of sulfur, 0.04% of chromium, 0.06% of soluble aluminum, 0.01% of niobium, 0.0018% of nitrogen, and 0.0008% of boron.

Our steels had nearly the same corrosion resistance as the conventional steel. In particular, steels C, F, I, and J, to which phosphorus was positively added with the chromium content reduced to less than 0.25%, and steels M, R, and S, to which cerium, calcium, or lanthanum was added together along with large amounts of phosphorus with the chromium content reduced, had good corrosion resistance. Steel N, to which copper and nickel were added together, had particularly good corrosion resistance.

In addition, steels V, W, Y, and AD, for which 0.6[% Si]+[% Cr]+2[% Mo] (denoted as "A" in the tables) was not less than 0.35, had insufficient conversion treatment properties with a large amount of coating that peeled off, whereas the steels for which the value of the expression was less than 0.35 had good conversion treatment properties.

Even if the chromium and molybdenum contents of a steel are reduced in view of corrosion resistance and conversion treatment properties, an appropriate manganese equivalent ([Mneq] in the tables), appropriate manganese and molybdenum contents, an appropriate value of 12[% P]+150B* (denoted as "C" in the tables), and appropriate cooling conditions in annealing inhibit formation of pearlite and bainite in the steel and increase the proportion of retained γ formed in the second phase, thus providing low YP and extremely little variation in material properties with varying annealing temperature and steel composition.

For example, of the steel sheets of steels A, B, and C, for which 12[% P]+150B* (denoted as "C" in the tables) was controlled to 0.42 or more, for those having appropriate annealing temperatures and first, second, and third cooling rates, the proportion of martensite and retained γ in the second phase was 70% or more, which indicates that formation of pearlite and bainite was inhibited, the average particle size of the second phase was 0.9 μm or more, and the proportion of retained γ in the second phase was 30% or more. These steel sheets had low YPs, namely, 225 MPa or less, and ΔYPs of 20 MPa or less.

In addition, steels B and C, for which 12[% P]+150B* (denoted as "C" in the tables) was 0.49 or more, had lower ΔYPs than steel A. For these steels, the proportion of retained γ in the second phase was high, namely, 40% or more.

In addition, steels D and E, for which [Mneq]≥2.0, had low YPs and ΔYPs with increased proportions of martensite and retained γ in the second phase. A comparison between steels B, D, and E reveals that increasing [Mneq] while controlling 12[% P]+150B* (denoted as "C" in the tables) further reduces YP and ΔYP.

In addition, steels G, H, I, and J, which had gradually increased carbon contents, had lower or similar YPs for the same strength level and smaller amounts of variation in YP, ΔYPs, with varying annealing temperature than the conventional steels for which the manganese or molybdenum content or 12[% P]+150B* (denoted as "C" in the tables) was not controlled.

With the annealing temperature and the first, second, and third cooling rates falling within the particular ranges, our steels achieved good material properties with a particular form of microstructure. In particular, the steel sheets for which the second cooling rate was controlled to 10° C./sec or higher with a sufficiently low rapid cooling stop temperature had lower YPs because formation of bainite was inhibited, second phase grains were uniformly and coarsely dispersed, and the volume fraction of martensite and retained γ increased.

On the other hand, steels T, X, and Y, for which [Mneq] was inappropriate, had high YPs and ΔYPs. Steel U, for which [Mneq] was appropriate but 12[% P]+150B* (denoted as "C" in the tables) was inappropriate, had a high YP and ΔYP. Steel AC, to which an excessive amount of phosphorus was added, had little variation in material properties but had a high YP.

Steel AD, to which a large amount of molybdenum was added, had a high YP. Steels AE, AF, and AG, which had an inappropriate titanium, carbon, or nitrogen content, had high YPs.

If the annealing temperature or the cooling conditions are inappropriate, even a steel having an appropriate steel composition exhibits high YP and ΔYP because the desired micro-structure cannot be formed. For example, Steel Sheet Nos. 1, 10, 17, 22, and 23, which had high rapid cooling stop temperatures in rapid cooling in the range of 480° C. or lower and consequently had low second cooling rates, had high YPs and YPs because the proportion of martensite in the second phase was low or the amount of martensite or retained γ formed was small.

Thus, controlling the form and type of microstructure by adjusting the annealing conditions while positively utilizing phosphorus and boron is extremely effective in reducing YP and variation in material properties while ensuring sufficient corrosion resistance and conversion treatment properties.

TABLE 1

| Steel | Chemical composition (% by mass) | | | | | | | | | | |
|---|---|---|---|---|---|---|---|---|---|---|---|
| No. | C | Si | Mn | P | S | sol. Al | N | Cr | Mo | Ti | V |
| A | 0.026 | 0.01 | 1.78 | 0.020 | 0.008 | 0.050 | 0.0022 | 0.18 | 0.01 | 0 | 0 |
| B | 0.028 | 0.01 | 1.65 | 0.034 | 0.005 | 0.030 | 0.0014 | 0.18 | 0 | 0 | 0 |
| C | 0.030 | 0.01 | 1.33 | 0.046 | 0.001 | 0.064 | 0.0029 | 0.22 | 0.01 | 0 | 0 |
| D | 0.030 | 0.02 | 1.54 | 0.024 | 0.003 | 0.035 | 0.0018 | 0.08 | 0 | 0 | 0 |

TABLE 1-continued

| | | | | | | | | | | | |
|---|---|---|---|---|---|---|---|---|---|---|---|
| E | 0.028 | 0.01 | 1.53 | 0.024 | 0.004 | 0.072 | 0.0022 | 0.18 | 0 | 0 | 0 |
| F | 0.026 | 0.02 | 1.68 | 0.049 | 0.006 | 0.040 | 0.0030 | 0.16 | 0.01 | 0 | 0 |
| G | 0.022 | 0.01 | 1.44 | 0.030 | 0.006 | 0.050 | 0.0044 | 0.27 | 0.01 | 0 | 0 |
| H | 0.038 | 0.01 | 1.46 | 0.033 | 0.007 | 0.073 | 0.0025 | 0.15 | 0.03 | 0 | 0 |
| I | 0.057 | 0.14 | 1.45 | 0.044 | 0.012 | 0.120 | 0.0022 | 0.13 | 0.01 | 0 | 0 |
| J | 0.099 | 0.20 | 1.60 | 0.049 | 0.003 | 0.050 | 0.0021 | 0.10 | 0.02 | 0.005 | 0 |
| K | 0.024 | 0.01 | 1.58 | 0.034 | 0.001 | 0.29 | 0.0010 | 0.16 | 0.01 | 0 | 0 |
| L | 0.025 | 0.02 | 1.48 | 0.029 | 0.002 | 0.050 | 0.0032 | 0.15 | 0.09 | 0.004 | 0 |
| M | 0.030 | 0.01 | 1.49 | 0.040 | 0.001 | 0.038 | 0.0028 | 0.18 | 0.02 | 0.006 | 0 |
| N | 0.022 | 0.01 | 1.52 | 0.038 | 0.002 | 0.085 | 0.0016 | 0.04 | 0.01 | 0 | 0 |
| O | 0.023 | 0.01 | 1.50 | 0.024 | 0.006 | 0.08 | 0.0035 | 0.24 | 0.02 | 0 | 0 |
| P | 0.030 | 0.01 | 1.20 | 0.024 | 0.005 | 0.079 | 0.0015 | 0.18 | 0.01 | 0 | 0.18 |
| Q | 0.023 | 0.01 | 1.51 | 0.025 | 0.010 | 0.040 | 0.0016 | 0.14 | 0.01 | 0 | 0 |
| R | 0.031 | 0.01 | 1.59 | 0.028 | 0.002 | 0.066 | 0.0020 | 0.18 | 0.01 | 0 | 0 |
| S | 0.026 | 0.01 | 1.60 | 0.026 | 0.002 | 0.088 | 0.0010 | 0.20 | 0.01 | 0 | 0 |

| Steel | Chemical composition (% by mass) | | | | A | B | C | Tc(° C.) |
|---|---|---|---|---|---|---|---|---|
| No. | B | B* | others | [Mneq] | (1) | (2) | (3) | (4) |
| A | 0.0008 | 0.0013 | — | 2.40 | 0.21 | 1.18 | 0.44 | 358 |
| B | 0.0013 | 0.0016 | — | 2.40 | 0.19 | 1.65 | 0.65 | 364 |
| C | 0.0016 | 0.0022 | — | 2.35 | 0.25 | 1.36 | 0.88 | 375 |
| D | 0.0013 | 0.0017 | — | 2.08 | 0.09 | 1.54 | 0.54 | 371 |
| E | 0.0015 | 0.0022 | — | 2.29 | 0.19 | 1.53 | 0.62 | 368 |
| F | 0 | 0.0000 | — | 2.31 | 0.19 | 1.71 | 0.59 | 363 |
| G | 0.0024 | 0.0022 | — | 2.39 | 0.30 | 1.47 | 0.69 | 369 |
| H | 0.0014 | 0.0021 | — | 2.34 | 0.22 | 1.56 | 0.72 | 372 |
| I | 0.0010 | 0.0022 | — | 2.33 | 0.23 | 1.48 | 0.86 | 373 |
| J | 0.0016 | 0.0022 | — | 2.52 | 0.26 | 1.67 | 0.92 | 368 |
| K | 0.0001 | 0.0022 | — | 2.42 | 0.19 | 1.61 | 0.74 | 367 |
| L | 0.0007 | 0.0020 | — | 2.51 | 0.34 | 1.78 | 0.65 | 371 |
| M | 0.0011 | 0.0022 | Ce: 0.003 | 2.44 | 0.23 | 1.56 | 0.81 | 370 |
| N | 0.0022 | 0.0022 | Cu: 0.18, Ni: 0.20 | 2.24 | 0.07 | 1.55 | 0.79 | 373 |
| O | 0.0016 | 0.0022 | Nb: 0.005 | 2.40 | 0.29 | 1.57 | 0.62 | 368 |
| P | 0.0015 | 0.0022 | — | 2.35 | 0.21 | 1.23 | 0.62 | 376 |
| Q | 0.0018 | 0.0022 | Zr: 0.04, W: 0.06 | 2.26 | 0.17 | 1.54 | 0.63 | 370 |
| R | 0.0014 | 0.0021 | Ca: 0.005, Sb: 0.02 | 2.39 | 0.21 | 1.62 | 0.65 | 366 |
| S | 0.0012 | 0.0021 | La: 0.003 Sn: 0.01 | 2.41 | 0.23 | 1.63 | 0.62 | 365 |

Note (1):
A: 0.6[% Si] + [% Cr] + 2[% Mo]
Note (2):
B: [% Mn] + 3.3[% Mo]
Note (3):
C: 12[% P] + 150B*
Note (4):
Tc(° C.) = 435 − 40 × [% Mn] − 30 × [% Cr] − 30 × [% V]

TABLE 2

| Steel | Chemical composition (% by mass) | | | | | | | | | | |
|---|---|---|---|---|---|---|---|---|---|---|---|
| No. | C | Si | Mn | P | S | sol. Al | N | Cr | Mo | Ti | V |
| T | 0.003 | 0.01 | 1.50 | 0.006* | 0.007 | 0.060 | 0.0030 | 0.10 | 0 | 0 | 0 |
| U | 0.029 | 0.01 | 1.90 | 0.014* | 0.007 | 0.052 | 0.0032 | 0.20 | 0.03 | 0 | 0 |
| V | 0.027 | 0.01 | 1.60 | 0.010* | 0.012 | 0.045 | 0.0030 | 0.40* | 0 | 0 | 0 |
| W | 0.029 | 0.01 | 1.51 | 0.014* | 0.007 | 0.053 | 0.0041 | 0.60* | 0 | 0 | 0 |
| X | 0.021 | 0.01 | 2.22* | 0.028 | 0.008 | 0.058 | 0.0030 | 0.30* | 0 | 0 | 0 |
| Y | 0.038 | 0.01 | 0.50* | 0.043 | 0.008 | 0.059 | 0.0033 | 0.26 | 0.11 | 0 | 0 |
| Z | 0.015* | 0.01 | 1.98* | 0.014* | 0.012 | 0.020 | 0.0022 | 0.18 | 0.03 | 0 | 0 |
| AA | 0.034 | 0.01 | 2.05* | 0.022 | 0.010 | 0.045 | 0.0050 | 0.17 | 0.01 | 0 | 0 |
| AB | 0.085 | 0.01 | 2.09* | 0.028 | 0.009 | 0.040 | 0.0029 | 0.17 | 0.01 | 0 | 0 |
| AC | 0.025 | 0.01 | 1.68 | 0.059* | 0.004 | 0.065 | 0.0033 | 0.20 | 0.01 | 0 | 0 |
| AD | 0.024 | 0.02 | 1.45 | 0.012* | 0.006 | 0.061 | 0.0028 | 0.02 | 0.18* | 0 | 0 |
| AE | 0.027 | 0.01 | 1.72 | 0.030 | 0.002 | 0.059 | 0.0022 | 0.16 | 0.01 | 0.025* | 0 |
| AF | 0.012* | 0.01 | 1.50 | 0.035 | 0.004 | 0.064 | 0.0022 | 0.22 | 0 | 0 | 0 |
| AG | 0.029 | 0.01 | 1.55 | 0.028 | 0.004 | 0.068 | 0.0060* | 0.10 | 0 | 0 | 0 |
| AH | 0.028 | 0.00 | 1.75 | 0.030 | 0.001 | 0.015 | 0.0021 | 0.00 | 0 | 0.007 | 0.001 |
| AI | 0.023 | 0.01 | 1.82 | 0.016 | 0.001 | 0.039 | 0.0041 | 0.02 | 0 | 0.003 | 0.002 |
| AJ | 0.029 | 0.01 | 1.80 | 0.021 | 0.004 | 0.059 | 0.0035 | 0.01 | 0.01 | 0.004 | 0.002 |
| AK | 0.027 | 0.00 | 1.68 | 0.035 | 0.007 | 0.064 | 0.0033 | 0.18 | 0.01 | 0.003 | 0.004 |

TABLE 2-continued

| | | | | | | | | | | | |
|---|---|---|---|---|---|---|---|---|---|---|---|
| AL | 0.036 | 0.01 | 1.42 | 0.037 | 0.006 | 0.055 | 0.0039 | 0.22 | 0 | 0.005 | 0.008 |
| AM | 0.028 | 0.00 | 1.60 | 0.030 | 0.004 | 0.250 | 0.0035 | 0.17 | 0 | 0.004 | 0.002 |

| Steel | Chemical composition (% by mass) | | | | A | B | C | Tc(° C.) |
|---|---|---|---|---|---|---|---|---|
| No. | B | B* | others | [Mneq] | (1) | (2) | (3) | (4) |
| T | 0.0005 | 0.0011 | — | 1.84* | 0.11 | 1.50 | 0.24* | 372 |
| U | 0 | 0 | — | 2.37 | 0.27 | 2.00* | 0.17* | 353 |
| V | 0.0008 | 0.0013 | — | 2.39 | 0.41* | 1.60 | 0.31* | 359 |
| W | 0 | 0 | — | 2.40 | 0.61* | 1.51 | 0.17* | 357 |
| X | 0.0004 | 0.0010 | — | 2.98* | 0.31 | 2.22* | 0.48 | 337 |
| Y | 0.0018 | 0.0022 | — | 1.88* | 0.49* | 0.86 | 0.85 | 407 |
| Z | 0.0004 | 0.0006 | — | 2.52 | 0.25 | 2.08* | 0.26* | 350 |
| AA | 0.0003 | 0.0008 | — | 2.59 | 0.20 | 2.08* | 0.38* | 348 |
| AB | 0.0003 | 0.0007 | — | 2.67 | 0.20 | 2.12* | 0.44 | 346 |
| AC | 0.0009 | 0.0016 | — | 2.68 | 0.23 | 1.71 | 0.94* | 362 |
| AD | 0.0008 | 0.0014 | — | 2.38 | 0.39* | 2.04* | 0.36* | 376 |
| AE | 0.0010 | 0.0022 | — | 2.53 | 0.19 | 1.75 | 0.69 | 361 |
| AF | 0.0009 | 0.0015 | — | 2.30 | 0.23 | 1.50 | 0.65 | 368 |
| AG | 0.0032 | 0.0022 | — | 2.23 | 0.11 | 1.55 | 0.67 | 370 |
| AH | 0.0010 | 0.0022 | Ca: 0.0005 | 2.32 | 0.00 | 1.75 | 0.69 | 365 |
| AI | 0.0018 | 0.0022 | Cu: 0.01<br>Ni: 0.02 | 2.31 | 0.03 | 1.82 | 0.52 | 362 |
| AJ | 0.0020 | 0.0022 | Ce: 0.0005<br>Sn: 0.005 | 2.35 | 0.04 | 1.83 | 0.58 | 363 |
| AK | 0.0020 | 0.0022 | Ca: 0.0025<br>Sb: 0.005<br>Zr: 0.005 | 2.57 | 0.20 | 1.71 | 0.75 | 362 |
| AL | 0.0015 | 0.0022 | La: 0.0005<br>W: 0.005 | 2.38 | 0.25 | 1.45 | 0.77 | 372 |
| AM | 0.0010 | 0.0022 | Nb: 0.002<br>Mg: 0.0005 | 2.40 | 0.17 | 1.60 | 0.69 | 366 |

Note:
the values marked with * are out of the scope of the present invention.
Note (1):
A: 0.6[% Si] + [% Cr] + 2[% Mo]
Note (2):
B: [% Mn] + 3.3[% Mo]
Note (3):
C: 12[% P] + 150B*
Note (4):
Tc(° C.) = 435 − 40 × [% Mn] − 30 × [% Cr] − 30 × [% V]

TABLE 3

| | | Annealing conditions | | | | | | Microstructure | | | | |
|---|---|---|---|---|---|---|---|---|---|---|---|---|
| Steel sheet No. | Steel No. | Heating rate (° C./s) | AT (° C.) | First cooling rate (° C./s) | Second cooling rate from 480° C. to Tc (° C./s) | Rapid cooling stop temperature (° C.) | Third cooling rate from Tc to 200° C. (° C./s) | Volume fraction of second phase (%) | Volume fraction of ferrite (%) | Volume fraction of martensite (%) | Volume fraction of retained γ (%) | Proportion of martensite and retained γ in second phase (%) |
| 1 | A | 2.0 | 780 | 12 | 7* | 378 | 1.7 | 4.3 | 95.7 | 1.5 | 1.3 | 65* |
| 2 | | 2.0 | 780 | 12 | 9 | 355 | 1.6 | 4.4 | 95.6 | 2.1 | 1.6 | 84 |
| 3 | | 2.0 | 780 | 12 | 20 | 290 | 0.8 | 4.6 | 95.4 | 2.6 | 1.8 | 96 |
| 4 | B | 1.6 | 740* | 12 | 20 | 310 | 0.8 | 1.3 | 98.7 | 0.9* | 0.3* | 92 |
| 5 | | 1.6 | 770 | 12 | 20 | 310 | 0.8 | 3.9 | 96.1 | 1.9 | 1.9 | 97 |
| 6 | | 1.6 | 790 | 12 | 20 | 310 | 0.8 | 4.6 | 95.4 | 2.0 | 2.4 | 96 |
| 7 | | 1.6 | 820 | 12 | 20 | 310 | 0.8 | 5.3 | 94.7 | 1.8 | 2.7 | 85 |
| 8 | | 1.6 | 850* | 12 | 20 | 310 | 0.8 | 5.6 | 94.4 | 0.8* | 3.0 | 68* |
| 9 | | 1.6 | 790 | 2* | 20 | 310 | 0.8 | 4.0 | 96.0 | 0.6* | 0.8 | 35* |
| 10 | | 1.6 | | 12 | 7* | 385 | 1.1 | 4.5 | 95.5 | 1.1* | 2.0 | 69* |
| 11 | | 1.6 | | 12 | 40 | 270 | 1.5 | 5.0 | 95.0 | 2.4 | 2.6 | 100 |
| 12 | | 1.6 | | 12 | 40 | 270 | 20 | 5.0 | 95.0 | 2.4 | 2.6 | 100 |
| 13 | | 1.6 | | 70 | 20 | 310 | 0.8 | 8.3 | 91.7 | 2.2 | 3.5 | 69* |
| 14 | C | 2.0 | 790 | 8 | 45 | 300 | 0.8 | 4.8 | 95.2 | 1.6 | 2.9 | 94 |
| 15 | D | 2.4 | 780 | 15 | 40 | 280 | 0.8 | 4.8 | 95.2 | 1.7 | 2.0 | 77 |
| 16 | E | 1.5 | 780 | 15 | 40 | 290 | 0.8 | 4.4 | 95.6 | 1.6 | 2.3 | 89 |
| 17 | F | 1.6 | 780 | 15 | 5* | 385 | 1 | 3.7 | 96.3 | 0.5* | 1.8 | 62* |
| 18 | | 1.6 | 780 | 15 | 9 | 345 | 0.8 | 4.0 | 96.0 | 1.5 | 1.9 | 85 |
| 19 | | 2 | 780 | 15 | 48 | 258 | 2 | 4.2 | 95.8 | 1.8 | 2.2 | 95 |
| 20 | G | 1.4 | 785 | 16 | 25 | 295 | 0.8 | 3.5 | 96.5 | 1.8 | 1.5 | 94 |
| 21 | | 1.4 | 820 | 17 | 25 | 295 | 0.8 | 4.1 | 95.9 | 2.1 | 1.8 | 95 |
| 22 | | 1.4 | 780 | 10 | 7* | 381 | 1.2 | 2.0* | 98.0 | 0.9* | 0.9* | 90 |

TABLE 3-continued

| | | | | | | | | | | | | |
|---|---|---|---|---|---|---|---|---|---|---|---|---|
| 23 | H | 0.9 | 780 | 15 | 7* | 390 | 1.2 | 6.5 | 93.5 | 0.8* | 3.2 | 62* |
| 24 | | 1.5 | 780 | 15 | 40 | 280 | 0.8 | 7.4 | 92.6 | 2.7 | 3.7 | 86 |
| 25 | I | 1.5 | 780 | 15 | 25 | 300 | 0.8 | 9.9 | 90.1 | 4.5 | 4.2 | 88 |
| 26 | J | 1.4 | 780 | 15 | 25 | 300 | 0.8 | 11.8 | 88.2 | 6.9 | 4.4 | 96 |

| | Microstructure | | | Mechanical properties | | | | | | |
|---|---|---|---|---|---|---|---|---|---|---|
| Steel sheet No. | Proportion of retained γ in second phase (%) | Grain size of second phase (μm) | Type of micro-structure (1) | YP (MPa) | TS (MPa) | YR (%) | ΔYP (MPa) | Corro-sion loss (mm) | Maxi-mum peel width of coat-ing | Category |
| 1 | 30 | 0.8* | F + M + γ + B | 245* | 448 | 55 | 33* | 0.32 | Good | Comparative Example |
| 2 | 36 | 0.9 | F + M + γ + B | 225 | 455 | 49 | 17 | 0.32 | Good | Example |
| 3 | 39 | 1.1 | F + M + γ + B | 220 | 461 | 48 | 14 | 0.32 | Good | Example |
| 4 | 23* | 0.9 | F + M + γ + B | 257* | 429 | 60 | — | 0.31 | Good | Comparative Example |
| 5 | 49 | 1.2 | F + M + γ + B | 213 | 458 | 47 | — | 0.30 | Good | Example |
| 6 | 52 | 1.3 | F + M + γ + B | 216 | 464 | 47 | 12 | 0.30 | Good | Example |
| 7 | 51 | 1.4 | F + M + γ + B | 224 | 469 | 48 | — | 0.31 | Good | Example |
| 8 | 54 | 1.3 | F + M + γ + B | 234* | 471 | 50 | — | 0.32 | Good | Comparative Example |
| 9 | 20* | 1.1 | F + M + γ + P + B | 263* | 428 | 61 | 32* | 0.30 | Good | Comparative Example |
| 10 | 44 | 0.8* | F + M + γ + B | 229* | 438 | 52 | 41* | 0.31 | Good | Comparative Example |
| 11 | 52 | 1.3 | F + M + γ | 215 | 466 | 46 | 10 | 0.30 | Good | Example |
| 12 | 52 | 1.4 | F + M + γ | 220 | 469 | 47 | 11 | 0.30 | Good | Example |
| 13 | 42 | 0.9 | F + M + γ + B | 262* | 475 | 55 | 27* | 0.31 | Good | Comparative Example |
| 14 | 60 | 2.2 | F + M + γ + B | 218 | 465 | 47 | 7 | 0.36 | Good | Example |
| 15 | 42 | 0.9 | F + M + γ + B | 224 | 454 | 49 | 16 | 0.29 | Good | Example |
| 16 | 52 | 1.1 | F + M + γ + B | 220 | 458 | 48 | 13 | 0.33 | Good | Example |
| 17 | 49 | 1.0 | F + M + γ + B | 256* | 438 | 58 | 28* | 0.27 | Good | Comparative Example |
| 18 | 48 | 1.4 | F + M + γ + B | 224 | 460 | 49 | 10 | 0.29 | Good | Example |
| 19 | 52 | 1.5 | F + M + γ + B | 219 | 468 | 47 | 6 | 0.28 | Good | Example |
| 20 | 43 | 1.3 | F + M + γ + B | 214 | 439 | 49 | 4 | 0.38 | Good | Example |
| 21 | 44 | 1.4 | F + M + γ + B | 218 | 445 | 49 | — | 0.38 | Good | Example |
| 22 | 45 | 1.2 | F + M + γ + B | 230 | 431 | 53 | 34* | 0.38 | Good | Comparative Example |
| 23 | 49 | 1.0 | F + M + γ + B | 261* | 498 | 52 | 31* | 0.31 | Good | Comparative Example |
| 24 | 50 | 1.3 | F + M + γ + B | 220 | 531 | 41 | 20 | 0.29 | Good | Example |
| 25 | 42 | 1.7 | F + M + γ + B | 234 | 550 | 43 | 22 | 0.30 | Good | Example |
| 26 | 37 | 1.8 | F + M + γ + B | 268 | 598 | 45 | 28 | 0.26 | Good | Example |

Note:
the values marked with * are out of the scope of the present invention.
Note (1):
type of microstructure F: ferrite; M: martensite (including tempered martensite); γ: retained γ; P: pearlite; B: bainite

TABLE 4

| | | Annealing conditions | | | | | | Microstructure | | | | |
|---|---|---|---|---|---|---|---|---|---|---|---|---|
| Steel sheet No. | Steel No. | Heat-ing rate (° C./s) | AT (° C.) | First cooling rate (° C./s) | Second cooling rate from 480° C. to Tc (° C./s) | Rapid cooling stop temper-ature (° C.) | Third cooling rate from Tc to 200° C. (° C./s) | Volume fraction of second phase (%) | Volume frac-tion of ferrite (%) | Volume fraction of martens-ite (%) | Volume fraction of retained γ (%) | Proportion of martens-ite and retained γ in second phase (%) |
| 27 | K | 1.5 | 790 | 8 | 8 | 285 | 0.8 | 3.9 | 96.1 | 1.3 | 2.4 | 95 |
| 28 | L | 1.5 | 780 | 5 | 12 | 310 | 0.8 | 5.4 | 94.6 | 2.5 | 2.9 | 100 |
| 29 | M | 1.5 | 780 | 12 | 8 | 300 | 0.8 | 5.3 | 94.7 | 1.9 | 3.2 | 96 |
| 30 | N | 1.5 | 770 | 12 | 18 | 300 | 0.8 | 4.2 | 95.8 | 1.8 | 2.1 | 93 |
| 31 | O | 1.5 | 780 | 15 | 8 | 300 | 0.5 | 4.4 | 95.6 | 2.2 | 2.1 | 98 |
| 32 | P | 1.8 | 780 | 15 | 8 | 300 | 0.7 | 5.4 | 94.6 | 2.4 | 2.7 | 94 |
| 33 | Q | 1.8 | 780 | 15 | 12 | 300 | 0.8 | 4.6 | 95.4 | 2.0 | 2.2 | 91 |
| 34 | R | 1.0 | 780 | 15 | 12 | 300 | 0.8 | 6.0 | 94.0 | 2.3 | 3.2 | 92 |
| 35 | S | 2.5 | 780 | 15 | 10 | 300 | 0.8 | 4.7 | 95.3 | 2.2 | 2.3 | 96 |
| 36 | T | 2.5 | 780 | 15 | 10 | 300 | 0.8 | 4.6 | 95.4 | 0.9* | 1.0 | 41* |
| 37 | U | 2.0 | 770 | 15 | 12 | 305 | 0.8 | 4.2 | 95.8 | 2.9 | 0.9 | 90 |
| 38 | | 2.0 | 790 | 15 | 12 | 305 | 0.8 | 5.0 | 95.0 | 3.4 | 1.0 | 88 |

TABLE 4-continued

| | | | | | | | | | | | | |
|---|---|---|---|---|---|---|---|---|---|---|---|---|
| 39 | | 2.0 | 820 | 15 | 12 | 305 | 0.8 | 5.7 | 94.3 | 3.6 | 1.2 | 84 |
| 40 | | 2.0 | 790 | 15 | 4* | 425 | 3 | 4.3 | 95.7 | 1.3* | 0.9 | 51* |
| 41 | | 2.0 | 790 | 15 | 7* | 380 | 1.6 | 4.5 | 95.5 | 1.8 | 0.8 | 58* |
| 42 | | 10 | 790 | 15 | 12 | 310 | 0.8 | 5.1 | 94.9 | 3.8 | 0.9 | 92 |
| 43 | V | 3.0 | 780 | 15 | 15 | 300 | 0.8 | 5.0 | 95.0 | 3.7 | 1.0 | 94 |
| 44 | W | 3.0 | 780 | 15 | 12 | 300 | 0.8 | 5.0 | 95.0 | 3.7 | 1.1 | 96 |
| 45 | X | 2.0 | 780 | 15 | 15 | 320 | 0.8 | 5.6 | 94.4 | 4.8 | 0.8 | 100 |
| 46 | Y | 3.0 | 780 | 15 | 15 | 320 | 0.8 | 5.4 | 94.6 | 2.8 | 0.9 | 69* |
| 47 | Z | 3.0 | 770 | 15 | 12 | 310 | 0.8 | 2.7 | 97.3 | 2.0 | 0.7 | 100 |
| 48 | | 3.0 | 790 | 15 | 12 | 310 | 0.8 | 3.0 | 97.0 | 2.3 | 0.7 | 100 |
| 49 | | 3.0 | 820 | 17 | 12 | 310 | 0.8 | 4.0 | 96.0 | 3.1 | 0.9 | 100 |
| 50 | AA | 3.0 | 780 | 15 | 12 | 300 | 0.8 | 6.3 | 93.7 | 5.0 | 1.3 | 100 |
| 51 | AB | 2.0 | 780 | 15 | 12 | 300 | 0.8 | 10.4 | 89.6 | 8.4 | 2.0 | 100 |
| 52 | AC | 2.0 | 780 | 15 | 12 | 310 | 0.8 | 5.3 | 94.7 | 3.2 | 2.1 | 100 |
| 53 | AD | 2.0 | 780 | 15 | 12 | 300 | 0.8 | 4.4 | 95.6 | 3.1 | 0.9 | 91 |
| 54 | | 2.0 | 780 | 15 | 6* | 390 | 1.4 | 4.1 | 95.9 | 1.9 | 0.8 | 66* |
| 55 | AE | 3.0 | 780 | 15 | 10 | 300 | 0.8 | 5.0 | 95.0 | 2.8 | 2.2 | 100 |
| 56 | AF | 2.0 | 780 | 15 | 12 | 320 | 0.8 | 0* | 100.0 | 0* | 0* | — |
| 57 | AG | 2.0 | 780 | 15 | 12 | 320 | 0.8 | 4.8 | 95.2 | 1.6 | 1.2 | 58* |
| 58 | AH | 3.5 | 770 | 7 | 8 | 320 | 0.7 | 6.2 | 93.8 | 1.8 | 3.2 | 81 |
| 59 | | 1.0 | 750 | 7 | 8 | 290 | 0.6 | 5.4 | 94.6 | 2.8 | 1.8 | 85 |
| 60 | AI | 2.0 | 770 | 9 | 8 | 300 | 0.8 | 4.0 | 96.0 | 1.7 | 1.5 | 80 |
| 61 | AJ | 1.5 | 770 | 9 | 8 | 300 | 0.8 | 6.4 | 93.6 | 2.0 | 3.2 | 81 |
| 62 | AK | 0.9 | 770 | 9 | 8 | 300 | 1.0 | 5.0 | 95.0 | 1.9 | 2.7 | 92 |
| 63 | | 0.9 | 750 | 9 | 8 | 300 | 1.0 | 4.5 | 95.5 | 2.5 | 1.9 | 98 |
| 64 | AL | 1.2 | 770 | 10 | 9 | 290 | 1.0 | 6.7 | 93.3 | 2.9 | 3.0 | 88 |
| 65 | AM | 2.5 | 770 | 10 | 9 | 290 | 0.7 | 5.3 | 94.7 | 2.4 | 2.1 | 85 |

| Steel sheet No. | Microstructure: Proportion of retained γ in second phase (%) | Microstructure: Grain size of second phase (μm) | Microstructure: Type of microstructure (1) | Mechanical properties: YP (MPa) | Mechanical properties: TS (MPa) | Mechanical properties: YR (%) | Mechanical properties: ΔYP (MPa) | Corrosion loss (mm) | Maximum peel width of coating | Category |
|---|---|---|---|---|---|---|---|---|---|---|
| 27 | 62 | 1.4 | F + M + γ + B | 215 | 463 | 46 | 8 | 0.30 | Good | Example |
| 28 | 54 | 1.2 | F + M + γ | 224 | 462 | 48 | 16 | 0.31 | Good | Example |
| 29 | 60 | 1.5 | F + M + γ + B | 223 | 465 | 48 | 8 | 0.29 | Good | Example |
| 30 | 50 | 1.4 | F + M + γ + B | 219 | 458 | 48 | 10 | 0.20 | Good | Example |
| 31 | 48 | 1.3 | F + M + γ + B | 224 | 468 | 48 | 12 | 0.37 | Good | Example |
| 32 | 50 | 1.4 | F + M + γ + B | 220 | 462 | 48 | 10 | 0.34 | Good | Example |
| 33 | 48 | 1.3 | F + M + γ + B | 219 | 455 | 48 | 12 | 0.32 | Good | Example |
| 34 | 53 | 1.5 | F + M + γ + B | 218 | 461 | 47 | 8 | 0.29 | Good | Example |
| 35 | 49 | 1.5 | F + M + γ + B | 218 | 462 | 47 | 8 | 0.29 | Good | Example |
| 36 | 22* | 0.8* | F + M + γ + P + B | 260* | 436 | 60 | 30* | 0.35 | Good | Comparative Example |
| 37 | 21* | 0.7* | F + M + γ + B | 214 | 455 | 48 | — | 0.35 | Good | Comparative Example |
| 38 | 20* | 0.8* | F + M + γ + B | 226* | 462 | 49 | 28* | 0.35 | Good | Comparative Example |
| 39 | 21* | 0.9 | F + M + γ + B | 242* | 473 | 51 | — | 0.36 | Good | Comparative Example |
| 40 | 21* | 0.7* | F + M + γ + B | 276* | 450 | 61 | 33* | 0.36 | Good | Comparative Example |
| 41 | 18* | 0.7* | F + M + γ + B | 258* | 458 | 56 | 26* | 0.35 | Good | Comparative Example |
| 42 | 18* | 0.7* | F + M + γ + B | 242* | 469 | 52 | 32* | 0.35 | Good | Comparative Example |
| 43 | 20* | 1.1 | F + M + γ + B | 212 | 449 | 47 | 12 | 0.53* | Poor | Comparative Example |
| 44 | 22* | 1.2 | F + M + γ + B | 205 | 449 | 46 | 8 | 0.80* | Poor | Comparative Example |
| 45 | 14* | 0.7* | F + M + γ | 250* | 472 | 53 | 31* | 0.44* | Good | Comparative Example |
| 46 | 17* | 0.8 | F + M + γ + P + B | 264* | 448 | 59 | 25* | 0.39 | Poor | Comparative Example |
| 47 | 26* | 0.7* | F + M + γ | 217 | 434 | 50 | — | 0.32 | Good | Comparative Example |
| 48 | 23* | 0.7* | F + M + γ | 226* | 439 | 52 | 22* | 0.31 | Good | Comparative Example |
| 49 | 23* | 0.8 | F + M + γ | 239* | 445 | 54 | — | 0.32 | Good | Comparative Example |
| 50 | 21* | 0.7* | F + M + γ | 266* | 515 | 52 | 35* | 0.30 | Good | Comparative Example |
| 51 | 19* | 0.7* | F + M + γ | 315* | 598 | 53 | 38* | 0.29 | Good | Comparative Example |
| 52 | 40 | 1.4 | F + M + γ | 235* | 474 | 50 | 14 | 0.30 | Good | Comparative Example |

TABLE 4-continued

| | | | | | | | | | | |
|---|---|---|---|---|---|---|---|---|---|---|
| 53 | 20* | 0.9 | F + M + γ + B | 230* | 464 | 50 | 21* | 0.34 | Poor | Comparative Example |
| 54 | 20* | 0.8* | F + M + γ + B | 258* | 462 | 56 | 29* | 0.33 | Poor | Comparative Example |
| 55 | 44 | 0.9 | F + M + γ | 239* | 468 | 51 | 18 | 0.31 | Good | Comparative Example |
| 56 | — | — | F | 290* | 419 | 69 | 10 | 0.35 | Good | Comparative Example |
| 57 | 25* | 0.9 | F + M + γ + B | 264* | 460 | 57 | 24* | 0.29 | Good | Comparative Example |
| 58 | 52 | 1.1 | F + M + γ + B | 218 | 465 | 47 | 17 | 0.29 | Good | Example |
| 59 | 33 | 0.9 | F + M + γ + B | 212 | 451 | 47 | — | 0.29 | Good | Example |
| 60 | 38 | 0.9 | F + M + γ + B | 220 | 451 | 49 | 20 | 0.28 | Good | Example |
| 61 | 50 | 0.9 | F + M + γ + B | 225 | 480 | 47 | 19 | 0.27 | Good | Example |
| 62 | 54 | 1.1 | F + M + γ + B | 218 | 462 | 47 | 13 | 0.28 | Good | Example |
| 63 | 42 | 0.9 | F + M + γ + B | 215 | 455 | 47 | — | 0.28 | Good | Example |
| 64 | 45 | 1.2 | F + M + γ + B | 225 | 489 | 46 | 17 | 0.32 | Good | Example |
| 65 | 40 | 1.0 | F + M + γ + B | 219 | 464 | 47 | 18 | 0.32 | Good | Example |

Note:
the values marked with * are out of the scope of the present invention.
Note (1):
type of microstructure F: ferrite; M: martensite (including tempered martensite); γ: retained γ; P: pearlite; B: bainite

The invention claimed is:

1. A method of manufacturing a cold rolled steel sheet comprising:

hot-rolling and cold-rolling a steel slab having a composition comprising, in percent by mass, more than 0.015% to less than 0.100% of carbon, less than 0.40% of silicon, 1.0% to 1.9% of manganese, more than 0.015% to 0.05% of phosphorus, 0.03% or less of sulfur, 0.01% to 0.3% of soluble aluminum, 0.005% or less of nitrogen, less than 0.30% of chromium, 0.0050% or less of boron, less than 0.15% of molybdenum, 0.4% or less of vanadium, 0.02% or less of titanium, and 0.18% or less of copper, and satisfying formula (1):

$$0.6[\%\ Si]+[\%\ Cr]+2[\%\ Mo]<0.35 \quad (1)$$

wherein [% A] is content (% by mass) of alloying element A, the balance being iron and incidental impurities to form a steel sheet;

annealing the steel sheet at an annealing temperature of 750° C. to 830° C.;

subjecting the steel sheet to first cooling at an average cooling rate of 3° C./sec to 40° C./sec in a temperature range from the annealing temperature to 480° C.;

subjecting the steel sheet to second cooling at an average cooling rate of 8° C./sec to 80° C./sec in a temperature range from 480° C. to Tc (° C.) given by formula (6):

$$Tc=435-40\times[\%\ Mn]-30\times[\%\ Cr]-30\times[\%\ V] \quad (6)$$

wherein [% A]is the content (% by mass) of alloying element A; and subjecting the steel sheet to third cooling at an average cooling rate of 0.3° C./sec to less than 1° C./sec in a temperature range from Tc (° C.) to 200° C., wherein at least one of the first, second and third cooling rates is different from the other cooling rates and the third cooling rate is lower than the second cooling rate, and the second cooling rate is greater than the first cooling rate.

2. The method according to claim 1, wherein the steel slab further satisfies formulas (2) and (3):

$$2.0\leq[Mneq]\leq2.8 \quad (2)$$

$$[\%\ Mn]+3.3[\%\ Mo]\leq1.9 \quad (3)$$

wherein [% A]is content (% by mass) of alloying element A; and [Mneq]=[% Mn]+1.3[% Cr]+8[% P]+150B*+2[% V]+3.3[% Mo], wherein B*=[% B]+[% Ti]/48×10.8×0.9+[% sol.Al]/27×10.8×0.025, wherein if [% B]=0, B*=0, and if B*≥0.0022, B*=0.0022.

3. The method according to claim 1, wherein the steel slab further satisfies formula (4):

$$0.42\leq12[\%\ P]+150B^*\leq0.93 \quad (4)$$

wherein B*=[% B]+[% Ti]/48×10.8×0.9+[% sol.Al]/27×10.8 ×0.025, wherein if [% B]=0, B*=0, and if B*≥0.0022, B*=0.0022; and [% A] is the content (% by mass) of alloying element A.

4. The method according to claim 1, wherein the steel slab further satisfies formula (5):

$$0.49\leq12[\%\ P]+150B^*\leq0.93 \quad (5)$$

wherein B*=[% B]+[% Ti]/48×10.8 ×0.9+[% sol.Al]/27×10.8×0.025, wherein if [% B]=0, B*=0, and if B*≥0.0022, B*=0.0022; and [% A]is the content (% by mass) of alloying element A.

5. The method according to claim 1, wherein the composition further comprises, in percent by mass, one or more of less than 0.02% of niobium, 0.15% or less of tungsten, 0.1% or less of zirconium, 0.5% or less of nickel, 0.2% or less of tin, 0.2% or less of antimony, 0.01% or less of calcium, 0.01% or less of cerium, 0.01% or less of lanthanum, and 0.01% or less of magnesium.

6. A method of manufacturing a cold rolled steel sheet comprising:

hot-rolling and cold-rolling a steel slab having a composition comprising, in percent by mass, more than 0.015% to less than 0.100% of carbon, less than 0.40% of silicon, 1.0% to 1.9% of manganese, more than 0.015% to 0.05% of phosphorus, 0.03% or less of sulfur, 0.01% to 0.3% of soluble aluminum, 0.005% or less of nitrogen, less than 0.30% of chromium, 0.0050% or less of boron, less than 0.15% of molybdenum, 0.4% or less of vanadium, 0.02% or less of titanium, and 0.18% or less of copper, and satisfying formula (1):

$$0.6[\%\ Si]+[\%\ Cr]+2[\%\ Mo]<0.35 \quad (1)$$

wherein [% A] is content (% by mass) of alloying element A, the balance being iron and incidental impurities to form a steel sheet;

annealing the steel sheet at an annealing temperature of 750° C. to 830° C.;

subjecting the steel sheet to first cooling at an average cooling rate of 8° C./sec to 40° C./sec in a temperature range from the annealing temperature to 480° C.;

subjecting the steel sheet to second cooling at an average cooling rate of 8° C/sec to 40° C./sec in a temperature range from 480° C. to Tc (° C.) given by formula (6):

$$Tc=435-40\times[\%\ Mn]-30\times[\%\ Cr]-30\times[\%\ V] \quad (6)$$

wherein [% A] is the content (% by mass) of alloying element A; and subjecting the steel sheet to third cooling at an average cooling rate of 0.3° C./sec to less than 1° C./sec in a temperature range from Tc (° C.) to 200° C., wherein at least one of the first, second and third cooling rates is different from the other cooling rates and the third cooling rate is lower than the second cooling rate, and the second cooling rate is equal to or lower than the first cooling rate.

7. The method according to claim 6, wherein the steel slab further satisfies formulas (2) and (3):

$$2.0\leq[Mneq]\leq2.8 \quad (2)$$

$$[\%\ Mn]+3.3[\%\ Mo]\leq1.9 \quad (3)$$

wherein [% A]is content (% by mass) of alloying element A; and [Mneq]=[% Mn]+1.3[% Cr]+8[% P]+150B*+2[% V]+3.3[% Mo], wherein B*=[% B]+[% Ti]/48×10.8×0.9+[% sol.Al]/27×10.8×0.025, wherein if [% B]=0, B*=0, and if B*≥0.0022, B*=0.0022.

8. The method according to claim 6, wherein the steel slab further satisfies formula (4):

$$0.42\leq12[\%\ P]+150B^*\leq0.93 \quad (4)$$

wherein B*=[% B]+[% Ti]/48×10.8×0.9+[% sol.Al]/27×10.8×0.025, wherein if [% B]=0, B*=0, and if B*≥0.0022, B*=0.0022; and [% A]is the content (% by mass) of alloying element A.

9. The method according to claim 6, wherein the steel slab further satisfies formula (5):

$$0.49\leq12[\%\ P]+150B^*\leq0.93 \quad (5)$$

wherein B*=[% B]+[% Ti]/48×10.8×0.9+[% sol.Al]/27×10.8×0.025, wherein if [% B]=0, B*=0, and if B*≥0.0022, B*=0.0022; and [% A] is the content (% by mass) of alloying element A.

10. The method according to claim 6, wherein the composition further comprises, in percent by mass, one or more of less than 0.02% of niobium, 0.15% or less of tungsten, 0.1% or less of zirconium, 0.5% or less of nickel, 0.2% or less of tin, 0.2% or less of antimony, 0.01% or less of calcium, 0.01% or less of cerium, 0.01% or less of lanthanum, and 0.01% or less of magnesium.

* * * * *